US009423111B2

(12) United States Patent
Kotera et al.

(10) Patent No.: US 9,423,111 B2
(45) Date of Patent: Aug. 23, 2016

(54) ILLUMINATION DEVICE

(71) Applicant: PANASONIC CORPORATION, Osaka (JP)

(72) Inventors: Ryusuke Kotera, Osaka (JP); Hideharu Kawachi, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 345 days.

(21) Appl. No.: 13/892,553

(22) Filed: May 13, 2013

(65) Prior Publication Data

US 2014/0009924 A1 Jan. 9, 2014

(30) Foreign Application Priority Data

Jul. 9, 2012 (JP) ..... 2012-153917

(51) Int. Cl.

| | |
|---|---|
| ***F21V 21/005*** | (2006.01) |
| ***F21K 99/00*** | (2016.01) |
| ***F21V 19/04*** | (2006.01) |
| ***F21V 23/06*** | (2006.01) |
| *F21S 2/00* | (2016.01) |

(Continued)

(52) U.S. Cl.

CPC ..... *F21V 21/005* (2013.01); *F21K 9/30* (2013.01); *F21V 19/04* (2013.01); *F21V 23/06* (2013.01); *F21S 2/00* (2013.01); *F21Y 2101/02* (2013.01); *F21Y 2103/00* (2013.01); *F21Y 2105/006* (2013.01); *F21Y 2105/008* (2013.01); *F21Y 2113/00* (2013.01)

(58) Field of Classification Search

CPC ..... F21K 9/30; F21V 19/04; F21V 21/005; F21V 23/06; H01L 2023/4075; H01L 2023/4081; H01L 2023/4087; F21Y 2113/00; F21Y 2105/006; F21Y 2103/00; F21Y 2105/008; F21Y 2101/02; F21S 2/00

USPC ..... 362/219, 249.01, 249.02, 249.1, 427

See application file for complete search history.

(56) References Cited

U.S. PATENT DOCUMENTS

2006/0087843 A1* 4/2006 Setomoto et al. ..... 362/249
2010/0053956 A1 3/2010 Park et al.

(Continued)

FOREIGN PATENT DOCUMENTS

CN 101852413 10/2010
CN 102454883 5/2012

(Continued)

OTHER PUBLICATIONS

Office Action issued in China Counterpart Patent Appl. No. 201310283678.0, dated Sep. 16, 2015 , along with an English translation thereof.

(Continued)

*Primary Examiner* — Sharon Payne

(74) *Attorney, Agent, or Firm* — Greenblum & Bernstein, P.L.C.

(57) ABSTRACT

An illumination device includes a plurality of flat light source units and an elongated base unit to which the light source units are removably attached. The base unit includes one or more connectors connected to the light source units and used in supplying an electric current to the light source units and a plurality of connector attachment portions arranged at a specified interval along a longitudinal direction of the base unit. The connectors are removably attached to the connector attachment portions.

18 Claims, 22 Drawing Sheets

(51) Int. Cl.

| | |
|---|---|
| *F21Y 101/02* | (2006.01) |
| *F21Y 103/00* | (2016.01) |
| *F21Y 105/00* | (2016.01) |
| *F21Y 113/00* | (2016.01) |

(56) References Cited

U.S. PATENT DOCUMENTS

| | | | | |
|---|---|---|---|---|
| 2010/0203757 | A1 | 8/2010 | Mostoller et al. | |
| 2011/0242805 | A1* | 10/2011 | Jin et al. | 362/231 |
| 2014/0240966 | A1* | 8/2014 | Garcia et al. | 362/183 |

FOREIGN PATENT DOCUMENTS

| | | |
|---|---|---|
| EP | 2209165 | 7/2010 |
| JP | 2006-32057 | 2/2006 |
| JP | 2012-104504 | 5/2012 |

OTHER PUBLICATIONS

China Office action, dated Feb. 15, 2015 along with an English translation thereof.

* cited by examiner

ILLUMINATION DEVICE

FIELD OF THE INVENTION

The present invention relates to an illumination device in which an organic EL (Eletro Luminescence) element is used as a light source.

BACKGROUND OF THE INVENTION

An organic EL element is capable of emitting high-brightness light at a low voltage and capable of producing different emission colors depending on the kind of organic compounds contained therein. In addition, the organic EL element can be easily formed into a flat light emitting panel. In recent years, therefore, attention has been given to the use of the organic EL element as a light source for an illumination device.

As an illumination device of this kind, there is available an illumination device that includes a light source unit using an organic EL element as a light source, a base unit for holding the light source unit and an electrode fixed to the base unit and used in supplying an electric current to the light source unit (see, e.g., Japanese Patent Application Publication No. 2012-104504).

In the illumination device referred to above, the electrode is fixed to the base unit. Therefore, limitations are imposed on the arrangement of the light source unit. This reduces the degree of freedom in arranging the light source unit.

SUMMARY OF THE INVENTION

In view of the above, the present invention provides an illumination device including a light source unit provided with an organic EL element as a light source, which is capable of increasing the degree of freedom in arranging the light source unit.

In accordance with an embodiment of the present invention, there is provided an illumination device, including: a plurality of flat light source units; and an elongated base unit to which the light source units are removably attached, wherein the base unit includes one or more connectors connected to the light source units and used in supplying an electric current to the light source units and a plurality of connector attachment portions arranged at a specified interval along a longitudinal direction of the base unit, the connectors being removably attached to the connector attachment portions.

Each of the light source units may be configured such that, when mounted to the base unit, the length of each of the light source units in the longitudinal direction of the base unit becomes an integral multiple of the distance between the connector attachment portions.

Each of the connectors may be arranged in a border position of the light source units adjoining each other when the light source units are mounted to the base unit in a mutually-adjoining relationship along the longitudinal direction of the base unit, each of the connectors configured to electrically interconnect the light source units adjoining each other.

The base unit may include a pair of parallel sides extending in the longitudinal direction of the base unit, a transverse length of the base unit being equal to the length of each of the light source units in a transverse direction of the base unit.

The base unit may include an engaged portion arranged along one longitudinal side thereof and a held portion arranged along the other longitudinal side thereof, the engaged portion and the held portion being used in mounting the light source units to the base unit; and each of the light source units may include an engaging portion provided in a central region of one edge portion of a mounting surface of each of the light source units facing the base unit when the light source units are mounted to the base unit and configured to engage with the engaged portion of the base unit and a holding portion provided in a central region of the other edge portion of the mounting surface and configured to engage with the held portion of the base unit.

The engaged portion and the held portion may differ in shape from each other, the engaged portion engaging with only the engaging portion, the held portion engaging with only the holding portion.

Each of the light source units may be configured to be able to swing toward the base unit in a state that the engaging portion is brought into engagement with the engaged portion of the base unit, the holding unit resiliently biased away from the engaging portion.

The held portion may include a claw extending toward the engaged portion; the holding portion includes a claw engageable with the claw of the held portion; the claws of the held portion and the holding portion are configured to, when each of the light source units is swung toward the base unit with the engaging portion brought into engagement with the engaged portion of the base unit, make contact with each other and generate a force by which the holding portion is slid toward the engaging portion.

Each of the light source units may include current supplying terminals upstanding from the mounting surface, the current supplying terminals inserted into each of the connectors.

The current supplying terminals may be provided near the engaging portion on the mounting surface, the connector attachment portions provided near the engaged portion in the base unit.

Each of the connectors may include terminal receivers extending along the transverse direction of the base unit when the connectors are attached to the base unit, the terminal receivers configured to grip the current supplying terminals.

The current supplying terminals may be provided in the opposite end portions of the mounting surface along a direction orthogonal to a direction interconnecting the engaging portion and the holding portion, the current supplying terminals being electrically connected to each other.

Each of the current supplying terminals may include a positive terminal and a negative terminal arranged side by side along a direction parallel to the direction interconnecting the engaging portion and the holding portion.

The base unit may include an end cap into which the current supplying terminals are inserted, the end cap having a surface made of an insulating material.

The base unit may include an input connector arranged in one longitudinal end portion thereof, the current supplying terminals inserted into the input connector, the input connector configured to electrically connect the current supplying terminals to a commercial power source, a driver or another illumination device.

The current supplying terminals may be inserted into the end cap are electrically connected via conductors to current supplying terminals provided outside the base unit.

The conductors may be extracted outward through a conductor extraction portion provided in the engaged portion or the held portion.

The held portion may include cutouts arranged in positions corresponding to the holding portions of the light source units mounted to the base unit.

With such configuration, the connectors for use in supplying an electric current to the light source units are removably attached arbitrary connector attachment portions. Therefore, the degree of freedom in arranging the light source units with respect to the base unit can be increased by changing the arrangement of the connectors.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Figure 1:
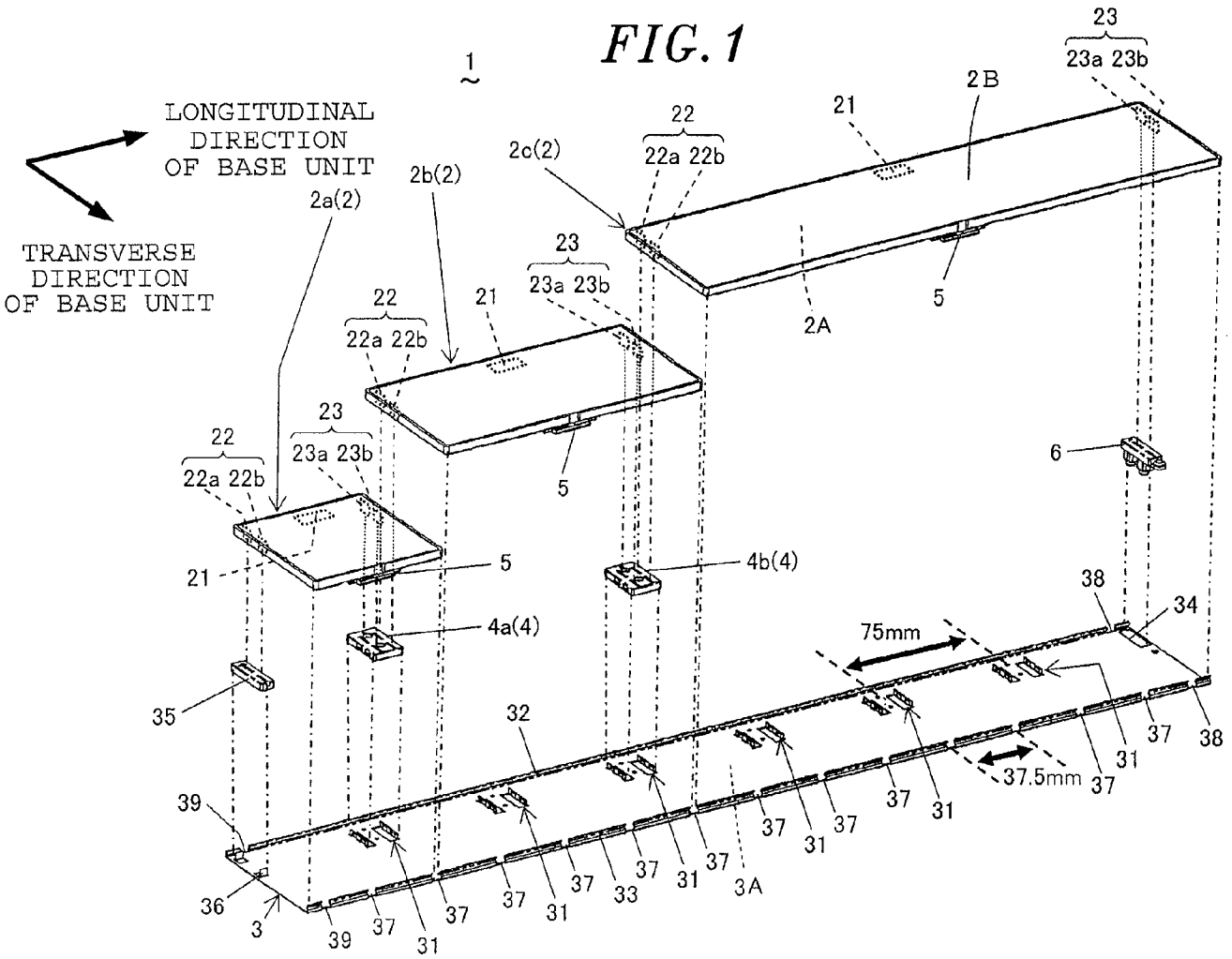
FIG. 1 is an exploded perspective view showing an illumination device according to an embodiment of the present invention.
Figure 2:
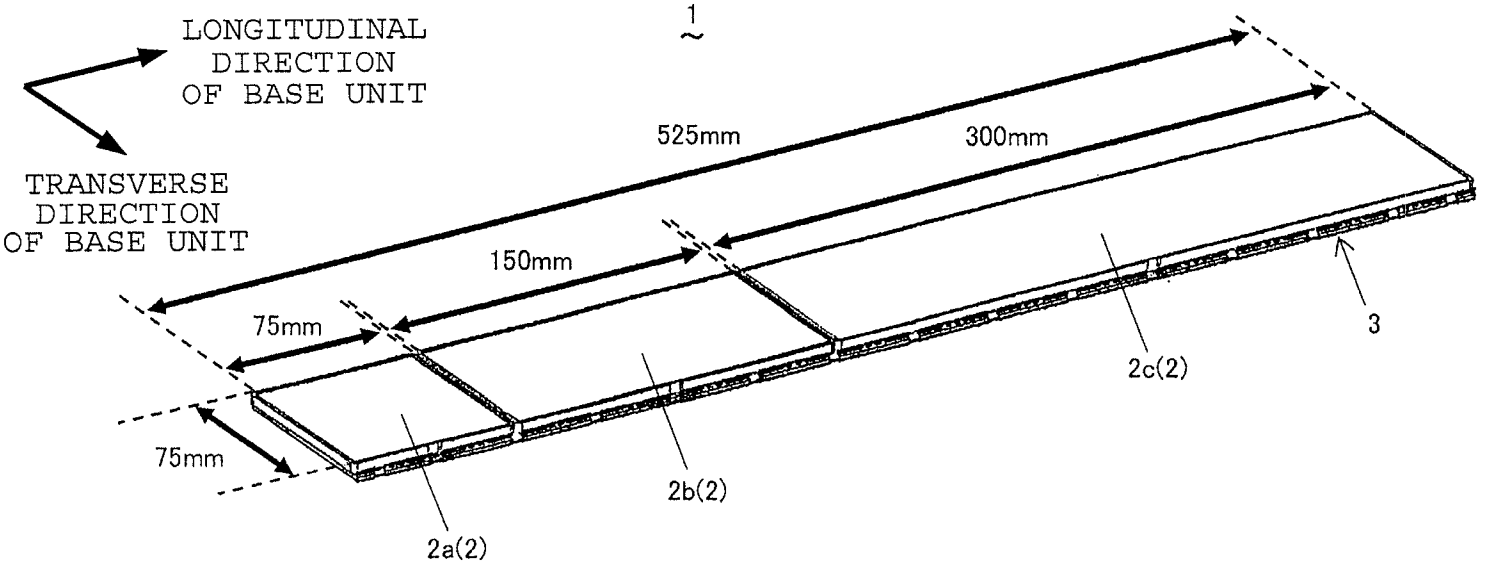
FIG. 2 is a perspective view of the illumination device shown in FIG. 1.

An illumination device according to an embodiment of the present invention will now be described with reference to FIGS. 1 through 17. As shown in FIGS. 1 and 2, the illumination device 1 includes a plurality of light source units 2 and an elongated base unit 3 to which the light source units 2 are removably mounted. The base unit 3 includes a plurality of connectors 4 connected to the light source units 2 and used in supplying an electric current to the light source units 2 and a plurality of connector attachment portions 31 to which the connectors 4 are removably attached. The connector attachment portions 31 are provided at a specified interval along the longitudinal direction of the base unit 3. In the illustrated example, the connector attachment portions 31 are provided at an interval of 75 mm starting from one longitudinal end of the base unit 3.

A plurality of light source units 2 is mounted to one base unit 3. In the illustrated example, three light source units 2*a*, 2*b* and 2*c* differing in size from one another are mounted to the base unit 3. Each of the light source units 2*a*, 2*b* and 2*c* is formed into a rectangular flat plate shape and is mounted to the base unit 3 on its mounting surface 2A. Each of the light source units 2*a*, 2*b* and 2*c* is configured such that, when mounted to the base unit 3, the length of the side (hereinafter referred to as "longitudinal side") of each of the light source units 2*a*, 2*b*, and 2*c* extending along the longitudinal direction of the base unit 3 is equal to an integral multiple of 75 mm (the distance between the connector attachment portions 31). In the illustrated example, the lengths of the longitudinal sides of the light source units 2*a*, 2*b*, and 2*c* are 75 mm, 150 mm and 300 mm (see FIG. 2), respectively. Each of the light source units 2*a*, 2*b*, and 2*c* is configured that such that, when mounted to the base unit 3, the length of the side (hereinafter referred to as "transverse side") of each of the light source units 2*a*, 2*b*, and 2*c* extending along the transverse direction of the base unit 3 is 75 mm. The light source units 2*a*, 2*b* and 2*c* are arranged in an order of 2*a*, 2*b* and 2*c* along the longitudinal direction of the base unit 3 in a mutually adjoining relationship.

Each of the light source units 2*a*, 2*b* and 2*c* includes an engaging portion 21 and a holding portion 5 arranged on the mounting surface 2A thereof and used in mounting each of the light source units 2*a*, 2*b* and 2*c* to the base unit 3. The engaging portion 21 is provided at a position corresponding to the center of one longitudinal side of each of the light source units 2*a*, 2*b* and 2*c*. The holding portion 5 is provided at a position corresponding to the center of the other longitudinal side of each of the light source units 2*a*, 2*b* and 2*c*.

Each of the light source units 2*a*, 2*b* and 2*c* includes a pair of current supplying terminals 22 and 23 upstanding from the mounting surface 2A thereof. The current supplying terminals 22 and 23 are arranged nearer to the engaging portion 21 than to the holding portion 5 on the mounting surface 2A and are provided in the opposite end regions of the mounting surface 2A in the direction orthogonal to the direction interconnecting the engaging portion 21 and the holding portion 5. The current supplying terminal 22 includes a positive terminal 22*a* and a negative terminal 22*b* which are arranged side by side along the direction parallel to the direction interconnecting the engaging portion 21 and the holding portion 5. Similarly, the current supplying terminal 23 includes a positive terminal 23*a* and a negative terminal 23*b* which are arranged side by side along the direction parallel to the direction interconnecting the engaging portion 21 and the holding portion 5. The positive terminals 22*a* and 23*a* are electrically connected to each other via a printed wiring substrate to be described later. Likewise, the negative terminals 22*b* and 23*b* are electrically connected to each other via the printed wiring substrate.

The base unit 3 is formed into an elongated rectangular flat plate shape and is attached to, e.g., a ceiling or a wall on its attachment surface 3A. In the illustrated example, the longitudinal dimension of the base unit 3 is set equal to 525 mm (=75 mm+150 mm+300 mm), i.e., the sum of the lengths of the longitudinal sides of the light source units 2*a*, 2*b*, and 2*c* (see FIG. 2). In other words, the light source units 2*a*, 2*b*, and 2*c* are arranged over the total longitudinal length of the base unit with no clearance left therebetween. Further, the transverse dimension of the base unit 3 is set equal to 75 mm, i.e., the length of the transverse side of each of the light source units 2*a*, 2*b*, and 2*c*.

The base unit 3 has a pair of longitudinal sides extending parallel to each other. The base unit 3 includes an engaged portion 32 and a held portion 33 arranged along one longitudinal side and the other longitudinal side, respectively. The engaged portion 32 engages with the engaging portion 21 of each of the light source units 2. The held portion 33 engages with the holding portion 5 of each of the light source units 2. The connector attachment portions 31 mentioned earlier are provided near the engaged portion 32 on the base unit 3.

The base unit 3 has an input connector attachment hole 34 arranged near the engaged portion 32 in one longitudinal end portion of the base unit 3 and used to attach an input connector 6 into which the current supplying terminal 23 of the light source unit 2*c* is inserted. The input connector 6 is used to electrically connect a commercial power source, a driver or another illumination device 1 to the current supplying terminal 23 of the light source unit 2*c*.

The base unit 3 includes an end cap attachment portion arranged near the engaged portion 32 in the other longitudinal end portion of the base unit 3 and used to attach an end cap 35 into which the current supplying terminal 22 of the light source unit 2*a* is inserted. The end cap 35 is configured so that it can also be mounted to the input connector attachment hole 34. The end cap 35 electrically interconnects the positive terminal 22*a* and the negative terminal 22*b* of the current supplying terminal 22 of the light source unit 2*a* or leads out conductors respectively connected to the positive terminal 22*a* and the negative terminal 22*b* so that the conductors can be connected to another illumination device (see FIGS. 19 and 20 to be described later). Each of the conductors is formed of, e.g., a lead wire or an electrically conductive metal plate coated with an insulating material except the portions connected to the positive terminal 22*a* and the negative terminal 22*b*. In the present embodiment, the end cap 35 electrically interconnects the positive terminal 22*a* and the negative terminal 22*b* of the current supplying terminal 22 of the light source unit 2*a*.

In order to facilitate the removal of each of the light source units 2*a*, 2*b*, and 2*c* mounted to the base unit 3, the held portion 33 of the base unit 3 includes a plurality of cutouts 37 provided in positions corresponding to the respective holding portions 5 of the light source units 2*a*, 2*b*, and 2*c*. The holding portion 5 of the light source unit 2*a* is arranged in a position corresponding to the middle position between the connector attachment portions 31. The holding portions 5 of the light source units 2*b* and 2*c* are arranged in positions corresponding to the connector attachment portions 31. In a corresponding relationship with the light source units 2*a*, 2*b* and 2*c*, the cutouts 37 are provided at an interval of 37.5 mm starting from one longitudinal end of the base unit 3.

The base unit 3 includes conductor extraction portions 38 formed in the engaged portion 32 and the held portion 33 near the input connector attachment hole 34. The conductors such as lead wires led out from the input connector 6 attached to the input connector attachment hole 34 pass through the conductor extraction portions 38. The base unit 3 further includes conductor extraction portions 39 formed in the engaged portion 32 and the held portion 33 near the end cap attachment portion 36. The conductors led out from the end cap 35 attached to the end cap attachment portion 36 pass through the conductor extraction portions 39.

The connectors 4 are attached to the connector attachment portions 31 so that the connectors 4 can be arranged at the border positions of the light source units 2 adjoining each other. In the illustrated example, the connector 4*a* is arranged at the border position of the light source units 2*a* and 2*b*. The connector 4*b* is arranged at the border position of the light source units 2*b* and 2*c*. The current supplying terminal 23 of the light source unit 2*a* and the current supplying terminal 22 of the light source unit 2*b* are inserted into the connector 4*a*. The current supplying terminal 23 of the light source unit 2*a* and the current supplying terminal 22 of the light source unit 2*b* are electrically connected to each other by a terminal receiver (see the description made later) arranged in the connector 4*a*. The current supplying terminal 23 of the light source unit 2*b* and the current supplying terminal 22 of the light source unit 2*c* are inserted into the connector 4*b*. The current supplying terminal 23 of the light source unit 2*b* and the current supplying terminal 22 of the light source unit 2*c* are electrically connected to each other by a terminal receiver (see the description made later) arranged in the connector 4*b*.

Figure 3:
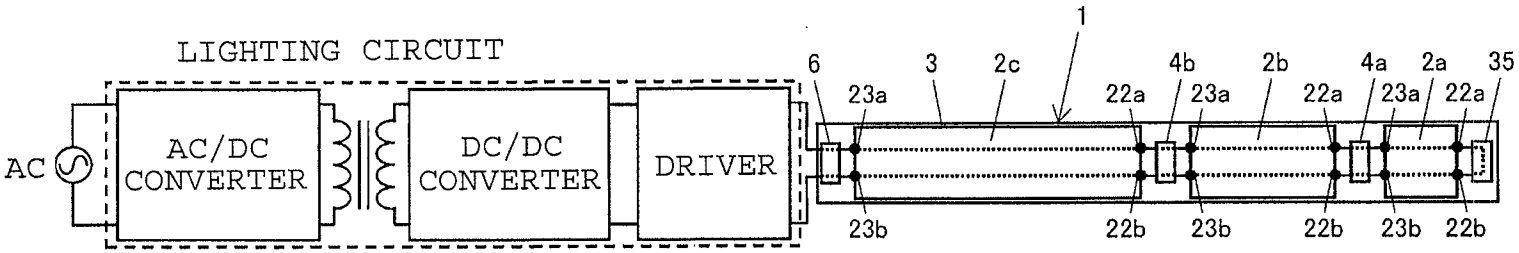
FIG. 3 is a circuit diagram of the illumination device shown in FIG. 1.

As shown in FIG. 3, the illumination device 1 is connected to a lighting circuit. The lighting circuit includes an AC/DC converter for converting an alternating current supplied from a commercial power source AC to a direct current, a DC/DC converter for converting a DC voltage to a desired DC voltage, and a driver for controlling the supply of the voltage-converted direct current to the illumination device 1. The AC/DC converter, the DC/DC converter and the driver are embedded in a ceiling or a wall to which the illumination device 1 is attached. The direct current supplied from the driver flows, in series, in an order of the input connector 6, the light source unit 2*c*, the connector 4*b*, the light source unit 2*b*, the connector 4*a*, the light source unit 2*a*, and the end cap 35.

As shown in FIGS. 4 through 6B, the light source unit 2*a* includes a light emitting panel 24 having a rectangular flat plate shape, a printed wiring board 25 for supplying an electric current to the light emitting panel 24 and a package 7 for accommodating the light emitting panel 24 and the printed wiring board 25.

The light emitting panel 24 uses an organic EL element as a light source. The light emitting panel 24 includes a light-transmitting substrate, a light emitting portion, and a sealing member for sealing the light emitting portion, which are arranged in order from the side of a light emitting surface 2B. The light emitting portion includes, e.g., a positive electrode formed of a transparent conductive film, a light emitting layer containing a light-emitting organic material, and a light-reflecting negative electrode, which are arranged in order from the side of the light-transmitting substrate. The sealing member serves to isolate the light emitting portion from ambient air, particularly moisture and oxygen, thereby preventing the light emitting portion from getting deteriorated.

The printed wiring board 25 includes terminal insertion portions 25*a* into which the positive terminals 22*a* and 23*a* of the light source unit 2*a* are inserted and terminal insertion portions 25*b* into which the negative terminals 22*b* and 23*b* of the light source unit 2*a* are inserted. The positive terminals 22*a* and 23*a* and the negative terminals 22*b* and 23*b* of the light source unit 2*a* are respectively inserted into the terminal insertion portions 25*a* and 25*b* and, therefore, are electrically connected to the printed wiring board 25. The terminal insertion portions 25*a* are electrically connected to each other by a wiring pattern (indicated by a dot line in FIG. 4) formed on the printed wiring board 25. The terminal insertion portions 25*b* are electrically connected to each other by a wiring pattern (indicated by a dot line in FIG. 4) formed on the printed wiring board 25.

The package 7 is formed into a rectangular box shape. The package 7 includes a case 8 covering the opposite surface of the light emitting panel 24 from the light emitting surface 2B and a light-transmitting cover 9 engaging with the case 8 and covering the light emitting surface 2B of the light emitting panel 24. The engaging portion 21 and the holding portion 5 are provided on the surface (the mounting surface 2A) of the case 8. The engaging portion 21 includes a claw 21*a* extending in the opposite direction from the holding portion 5 and engaging with the held portion 32 of the base unit 3.

The holding portion 5 includes a base 52 fixed to the mounting surface 2A by screws 51, springs 53 extending from the base 52 in the opposite direction from the engaging portion 21 (hereinafter referred to as "the engaging direction of the holding portion 5") with one ends of the springs 53 fixed to the base 52, and a claw 54 fixed to the other ends of the springs 53. The claw 54 extends in the engaging direction of the holding portion 5 and engages with the held portion 33 of the base unit 3. The holding portion 5 includes projections 55 extending from the claw 54 in a direction parallel to the longitudinal side of the base unit and restraint portions 56 upstanding from the mounting surface 2A to restrain the projections 55 from moving in the engaging direction of the holding portion 5. The restraint portions 56 include accommodation portions 56*a* for accommodating the projections 55 and walls 56*b* arranged at the side of the engaging direction of the holding portion 5 with respect to the accommodation portions 56*a* so as to make contact with the projections 55 (see FIGS. 6A and 6B). Thus, the claw 54 (indicated by dots in FIG. 6A) is resiliently biased in the engaging direction of the holding portion 5, whereby the claw 54 can slide in the engaging direction of the holding portion 5.

The case 8 is formed into a rectangular box shape so as to have an opening on the surface facing the light emitting panel 24. The case 8 includes recess portions 81 defined on the inner circumferential surface thereof and used in bringing the case 8 into engagement with the cover 9, and holes 82 formed on the mounting surface 2A thereof so that the current supplying terminals 22*a*, 22*b*, 23*a*, and 23*b* can protrude outward through the holes 82. The case 8 further includes a groove 83 formed on the side surface thereof near the holding portion 5 so that a jig (see the description made later) for use in removing the light source units 2 from the base unit 3 can pass through the groove 83.

Figure 4:
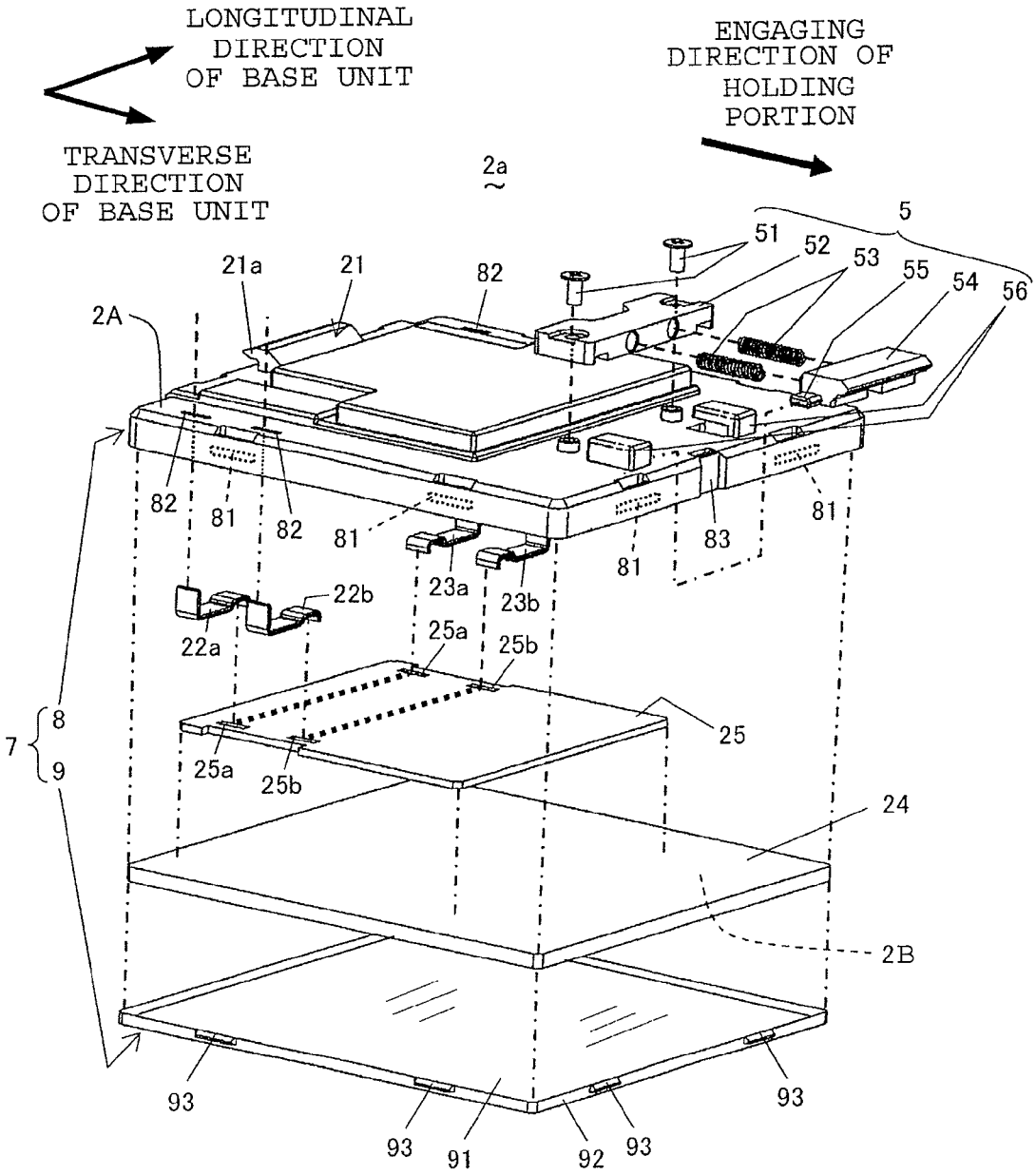
FIG. 4 is an exploded perspective view of a light source unit making up the illumination device.
Figure 5:
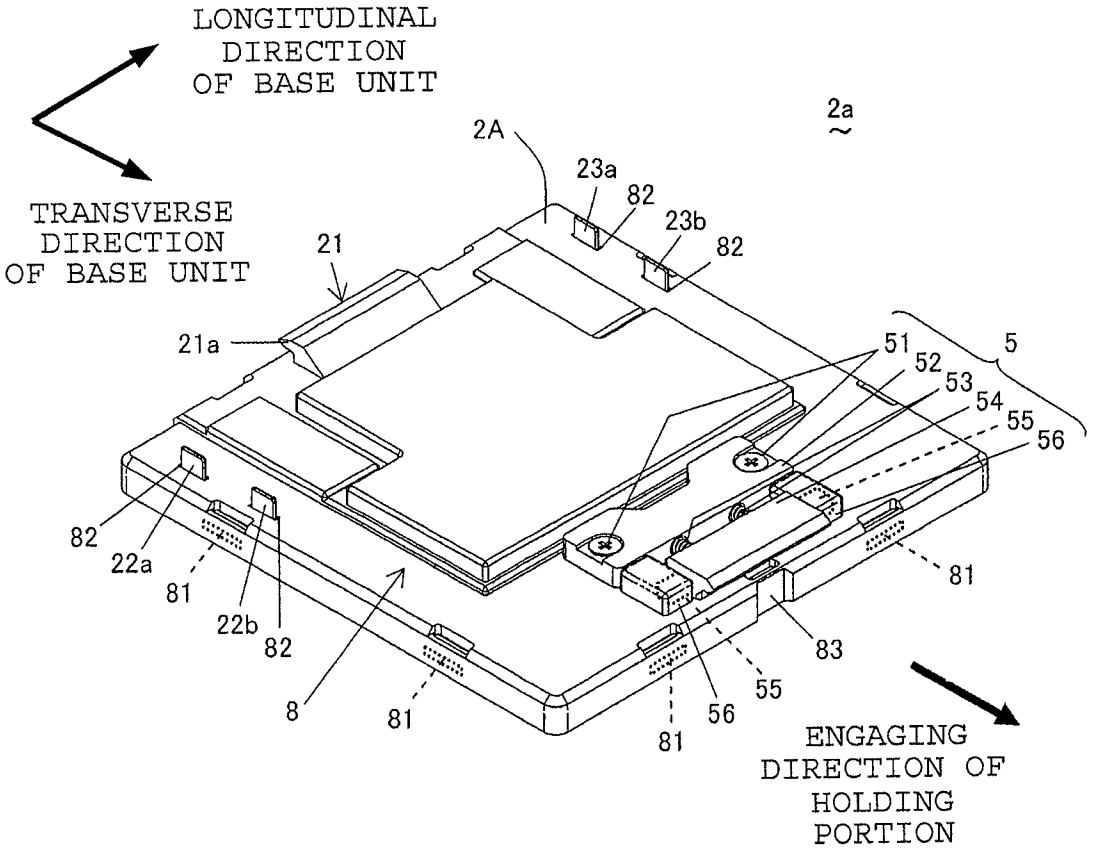
FIG. 5 is a perspective view of the light source unit.
Figure 6A:
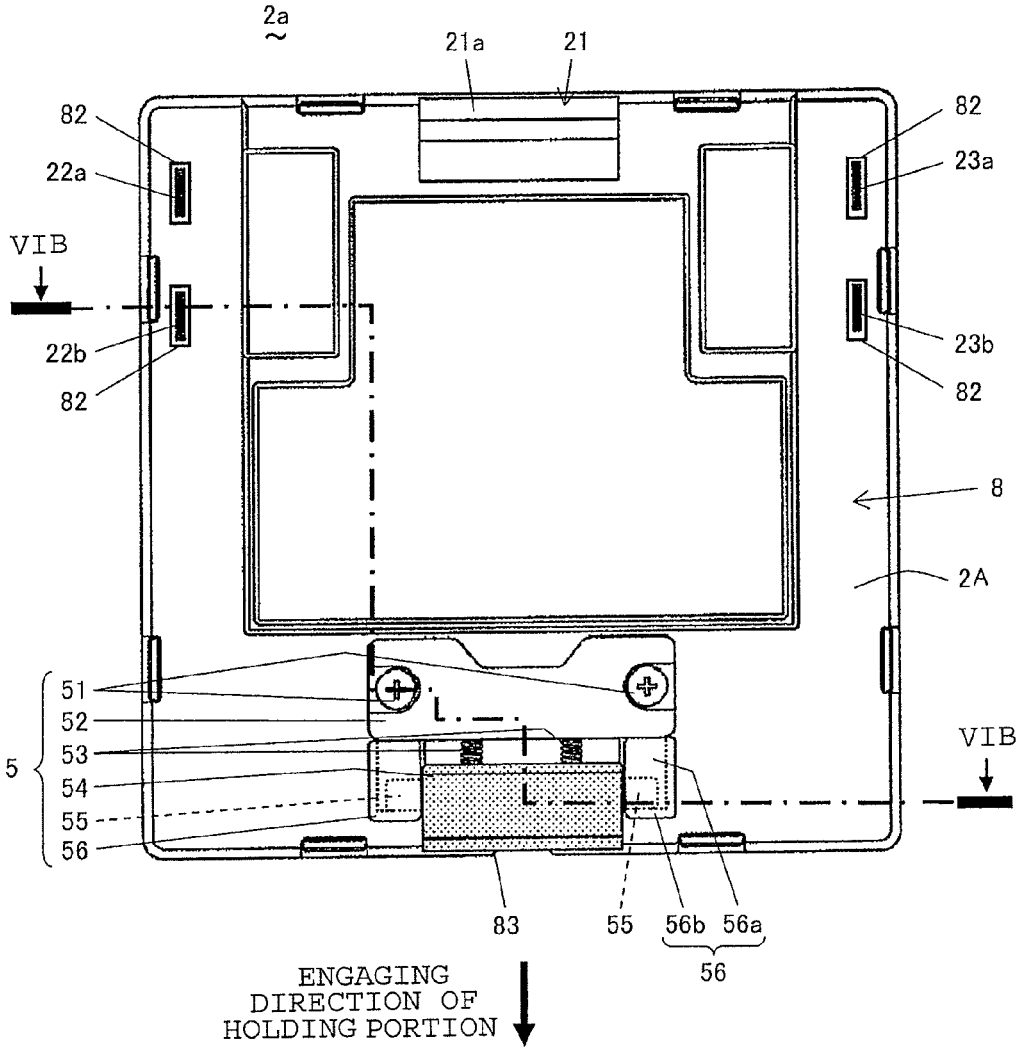
FIG. 6A is a plan view of the light source unit as seen at the side of a mounting surface.
Figure 6B:
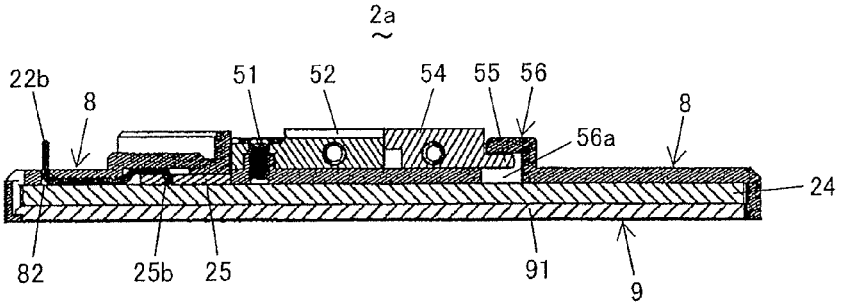
FIG. 6B is a section view taken along line VIB-VIB in FIG. 6A.

The cover 9 includes a rectangular light-transmitting member 91 covering the light emitting surface 2B of the light emitting panel 24, a rectangular frame 92 covering the peripheral edge of the light-transmitting member 91 and a plurality of protrusion portions 93 protruding outward from the respective sides of the frame 92 and engaging with the recess portions 81 of the case 8 (see FIG. 4).

Figure 7A:
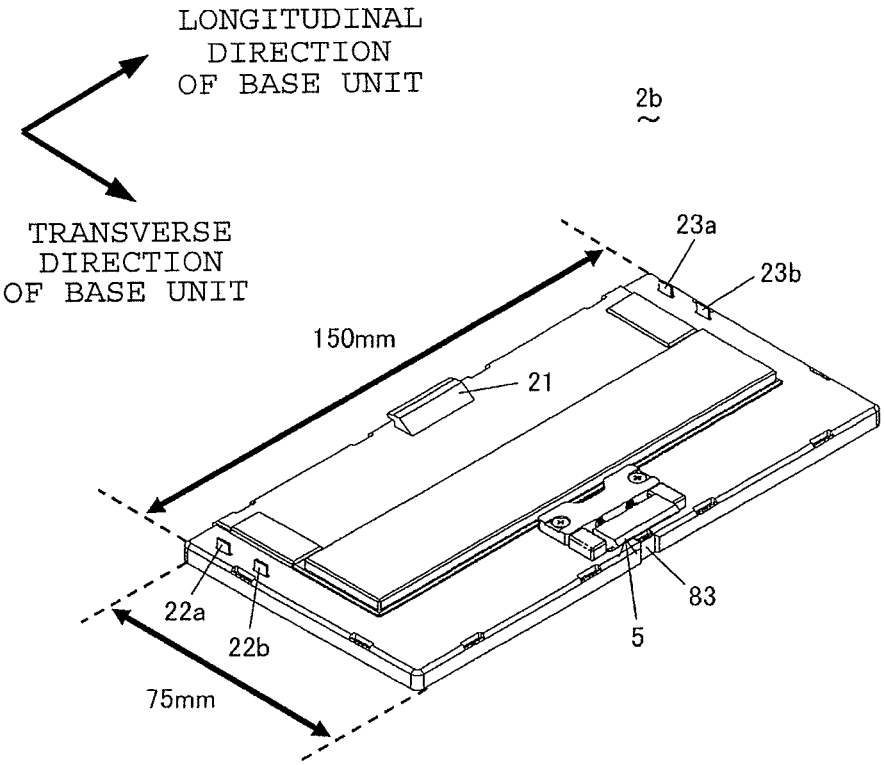
FIGS. 7A and 7B are perspective views showing different light source units.
Figure 7B:
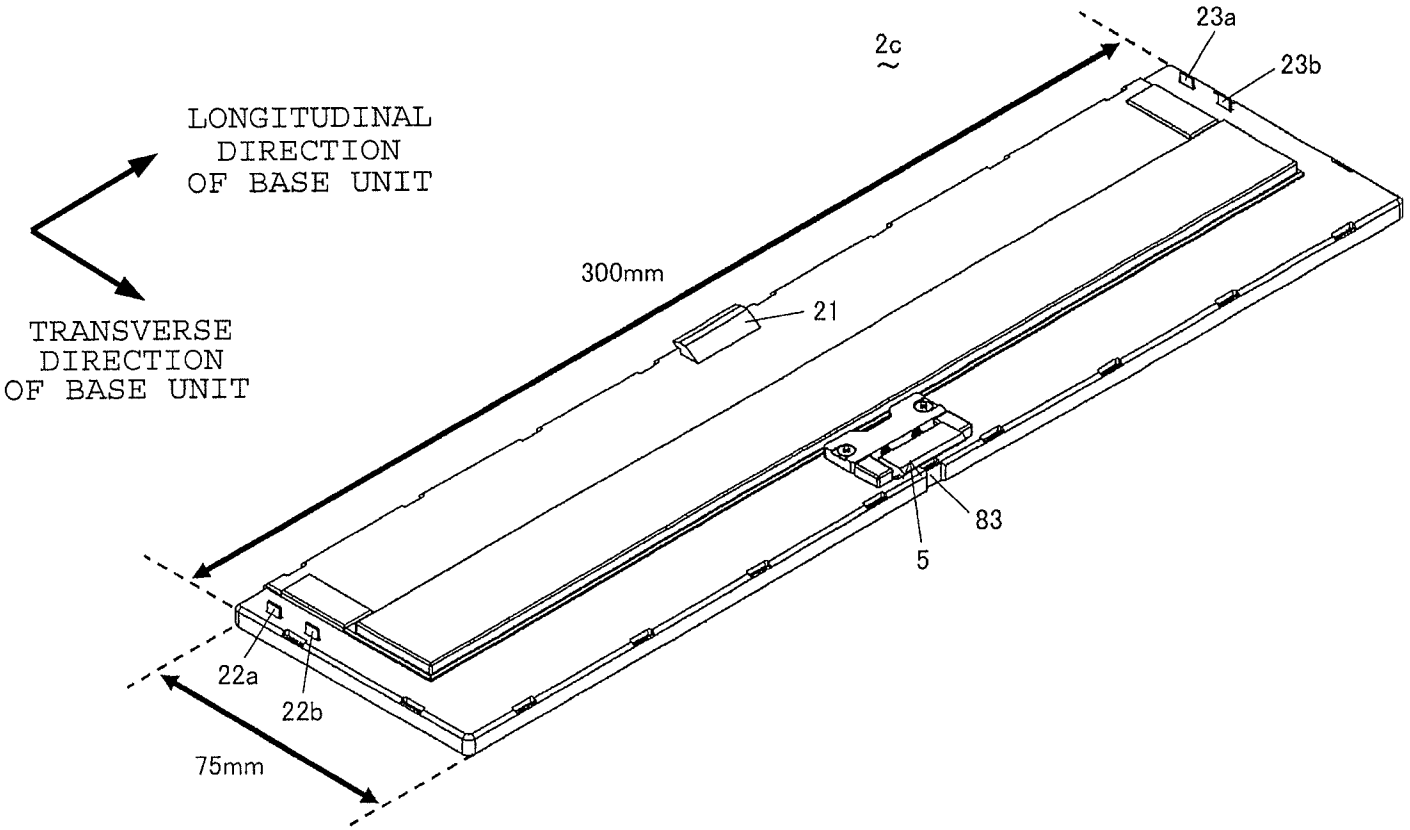

As shown in FIGS. 7A and 7B, the light source units 2*b* and 2*c* have the same configuration as the light source unit 2*a*, except that the lengths of the sides thereof extending in the longitudinal direction of the base unit 3 are two or four times as large as the length of the light source unit 2*a*. As the light source units 2 become longer, the distance from the longitudinal opposite ends thereof to the engaging portion 21 and the holding portion 5 grows larger. For this reason, there is likelihood that, when the light source units 2 are mounted to the base unit 3, the light source units 2 may be shaken with respect to the base unit 3 and further that the light source units 2 may be unstably held by the base unit 3. In light of this, it is preferred that the lengths of the longitudinal sides of the light source units 2 be set substantially equal to or smaller than the length of the light source unit 2*c* (300 mm which is four times greater than the length of the light source unit 2*a*). Alternatively, two or more sets of engaging portions 21 and holding portions 5 may be provided in each of the light source units 2. The lengths of the longitudinal sides of the light source units 2 are not limited to the lengths of the light source units 2*a*, 2*b*, and 2*c* but may be, e.g., three times as large as the length of the light source unit 2*a*.

Figure 8:
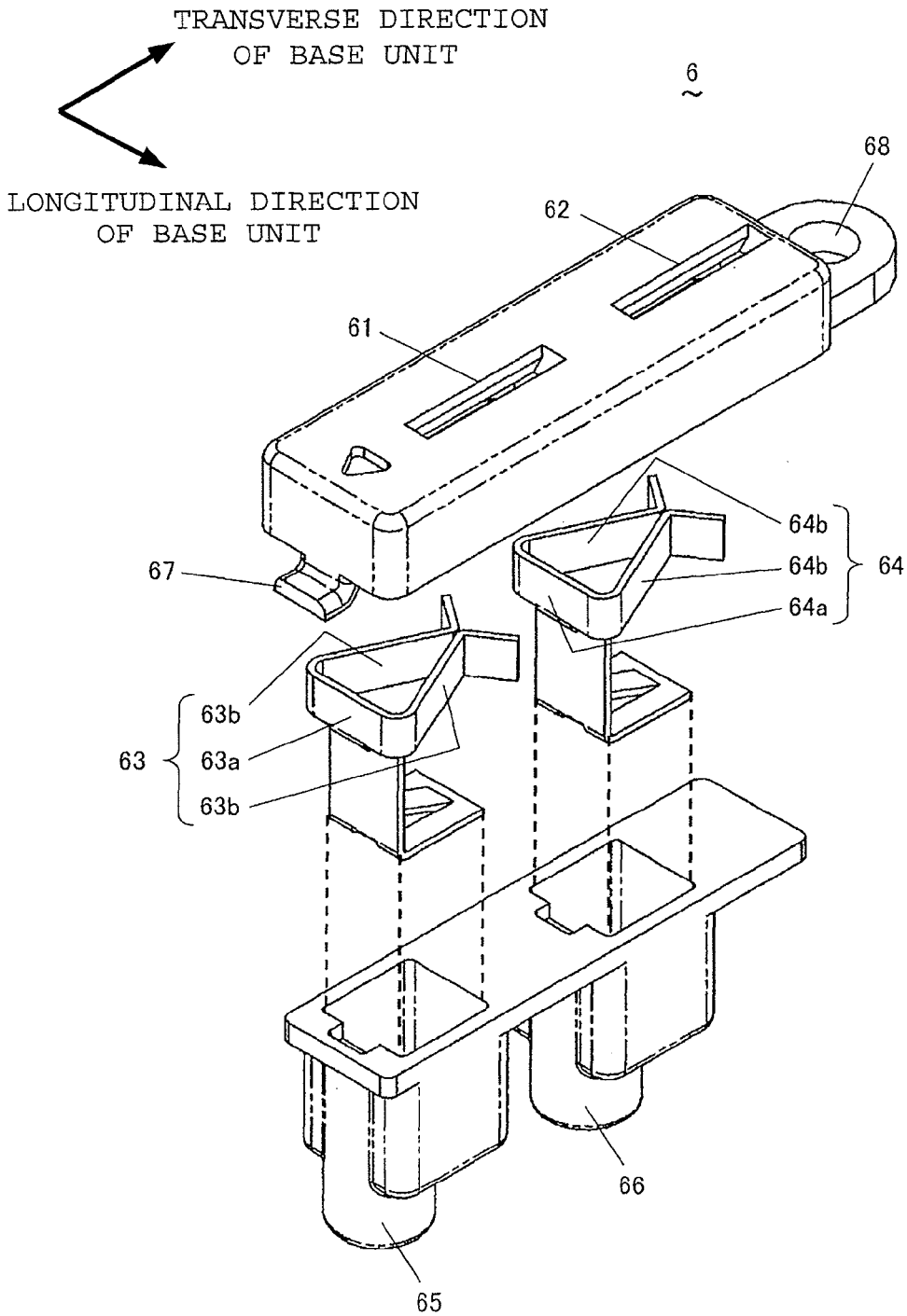
FIG. 8 is an exploded perspective view of an input connector making up the illumination device.
Figure 9:
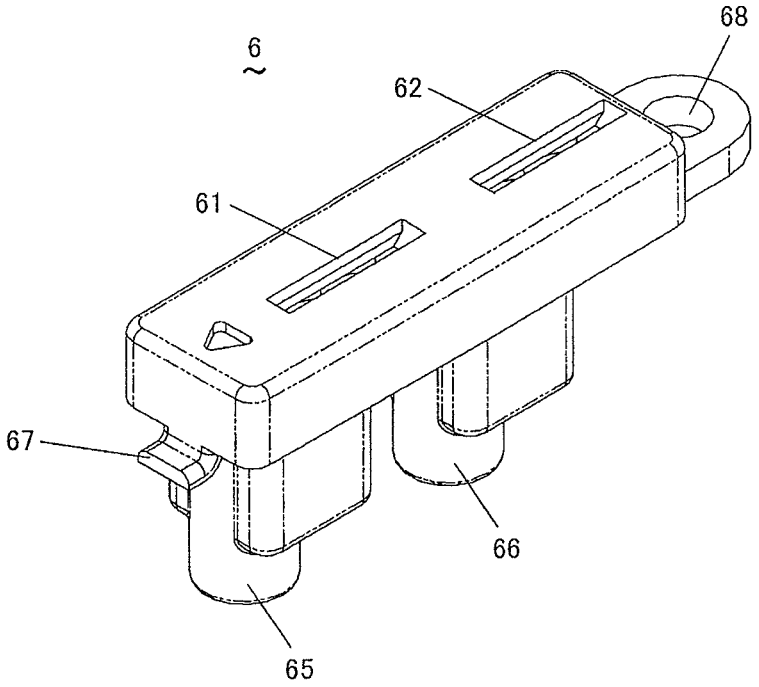
FIG. 9 is a perspective view of the input connector.

As shown in FIGS. 8 and 9, the input connector 6 includes a positive terminal insertion hole 61 into which the positive terminal 23*a* of the light source unit 2*c* is inserted and a negative terminal insertion hole 62 into which the negative terminal 23*b* of the light source unit 2*c* is inserted. The input connector 6 further includes a terminal receiver 63 for gripping the positive terminal 23*a* inserted into the positive terminal insertion hole 61, a terminal receiver 64 for gripping the negative terminal 23*b* inserted into the negative terminal insertion hole 62, and tubular accommodation portions 65 and 66 for accommodating the terminal receivers 63 and 64. The input connector 6 further includes a hook portion 67 used in attaching the input connector 6 to the base unit 3 and a screw hole 68 used in screw-fixing the input connector 6 to the base unit 3.

The terminal receiver 63 is formed by bending a leaf spring. The terminal receiver 63 includes a base portion 63*a* extending along the longitudinal direction of the base unit 3 when the input connector 6 is attached to the base unit 3 and a pair of extension portions 63*b* extending from the opposite ends of the base portion 63*a* along the substantially transverse direction of the base unit 3 so that the tip ends of the extension portions 63*b* can make contact with each other. Upon the positive terminal 23*a* of the light source unit 2*c* being resiliently gripped by the extension portions 63*b*, the terminal receiver 63 is electrically connected to the positive terminal 23*a*. The terminal receiver 64 has the same structure as the terminal receiver 63. The terminal receiver 64 is electrically connected to the negative terminal 23*b* of the light source unit 2*c*.

Figure 10:
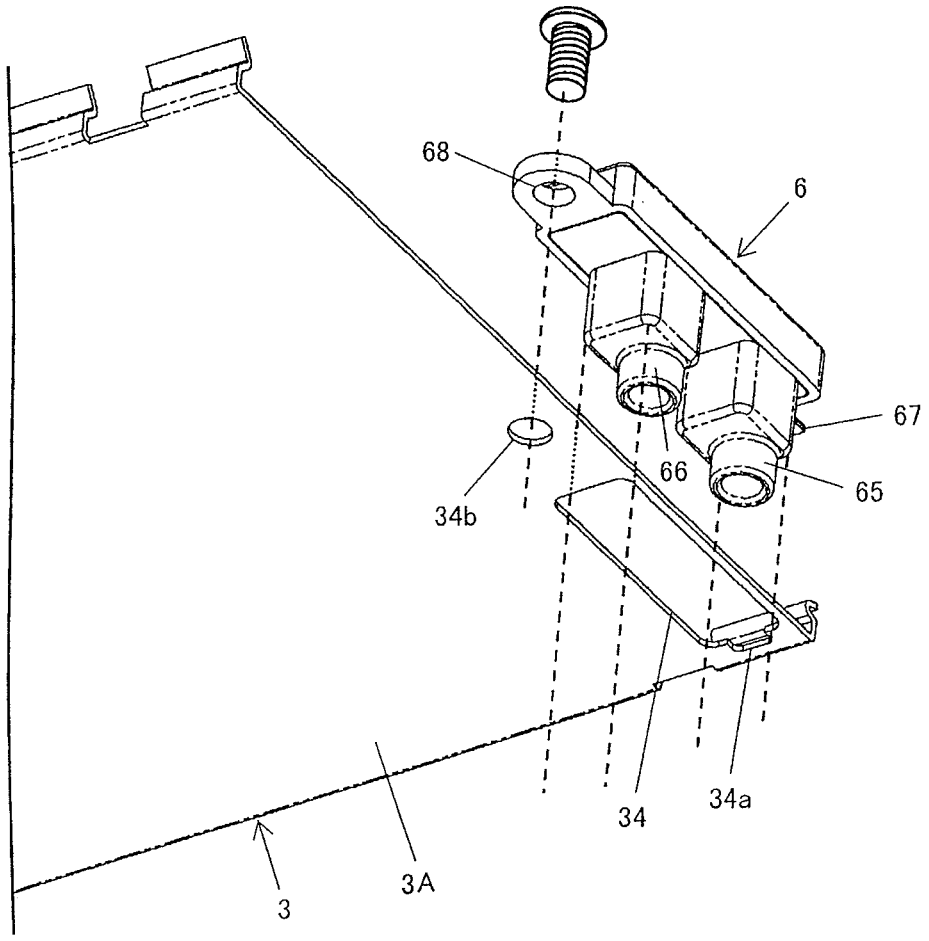
FIG. 10 is a view showing how to attach the input connector to a base unit.

As shown in FIG. 10, the input connector 6 is fixed to the base unit 3 so that the accommodation portions 65 and 66 can be exposed at the side of the attachment surface 3A of the base unit 3. This fixing is performed by bringing the hook portion 67 of the input connector 6 into engagement with a catch portion 34*a* provided in the input connector attachment hole 34 of the base unit 3 and then tightening a screw through the screw hole 68 of the input connector 6 and a screw hole 34*b* formed in the base unit 3. Conductors (not shown) such as lead wires electrically connected to the positive terminal and the negative terminal of the aforementioned driver (not shown) are inserted into the accommodation portions 65 and 66 of the input connector 6 exposed at the side of the attachment surface 3A of the base unit 3. The conductors are respectively connected to the terminal receivers 63 and 64. As a consequence, the input connector 6 and the driver are electrically connected to each other.

Figure 11:
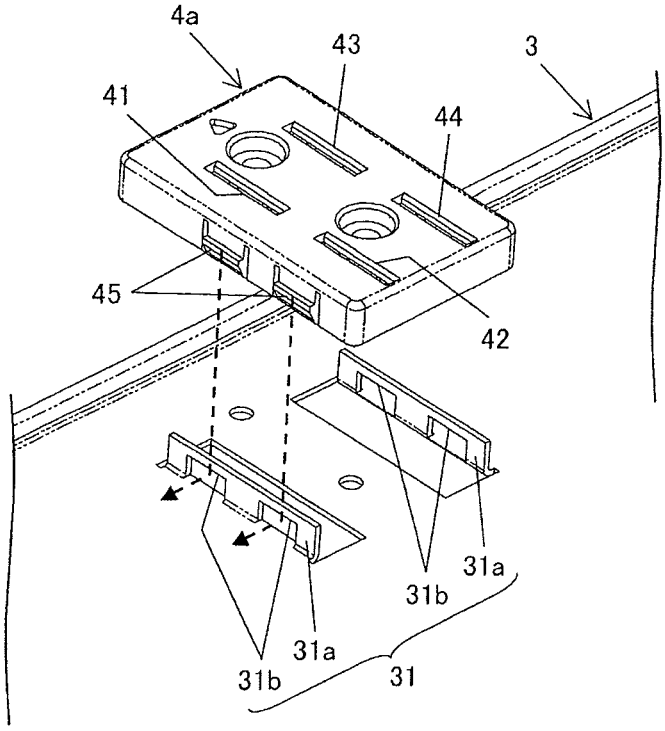
FIG. 11 is a view illustrating how to attach the connector of the illumination device to the base unit.

As shown in FIG. 11, the connector 4*a* is formed into a flat rectangular box shape. The connector 4*a* includes a positive terminal insertion hole 41 into which the positive terminal 23*a* of the light source unit 2*a* is inserted and a negative terminal insertion hole 42 into which the negative terminal 23*b* of the light source unit 2*a* is inserted. The positive terminal insertion hole 41 and the negative terminal insertion hole 42 are formed on one surface of the connector 4*a*. The connector 4*a* further includes a positive terminal insertion hole 43 into which the positive terminal 22*a* of the light source unit 2*b* is inserted and a negative terminal insertion hole 44 into which the negative terminal 22*b* of the light source unit 2*b* is inserted. The positive terminal insertion hole 43 and the negative terminal insertion hole 44 are formed on the one surface of the connector 4*a*. The connector 4*a* further includes a plurality of lugs 45 formed on the side surface thereof and used in bringing the connector 4*a* into engagement with the connector attachment portions 31.

Each of the connector attachment portions 31 includes a bent portion 31*a* formed by bending a portion of the surface of the base unit 3 on which the light source units 2 are mounted, and a plurality of depressed portions 31*b* formed in the bent portion 31*a* so as to come into engagement with the lugs 45 of the connector 4*a*. The connector 4*a* is removably attached to the connector attachment portions 31 by bringing the lugs 45 into engagement with the depressed portions 31*b* of the connector attachment portions 31.

Figure 12:
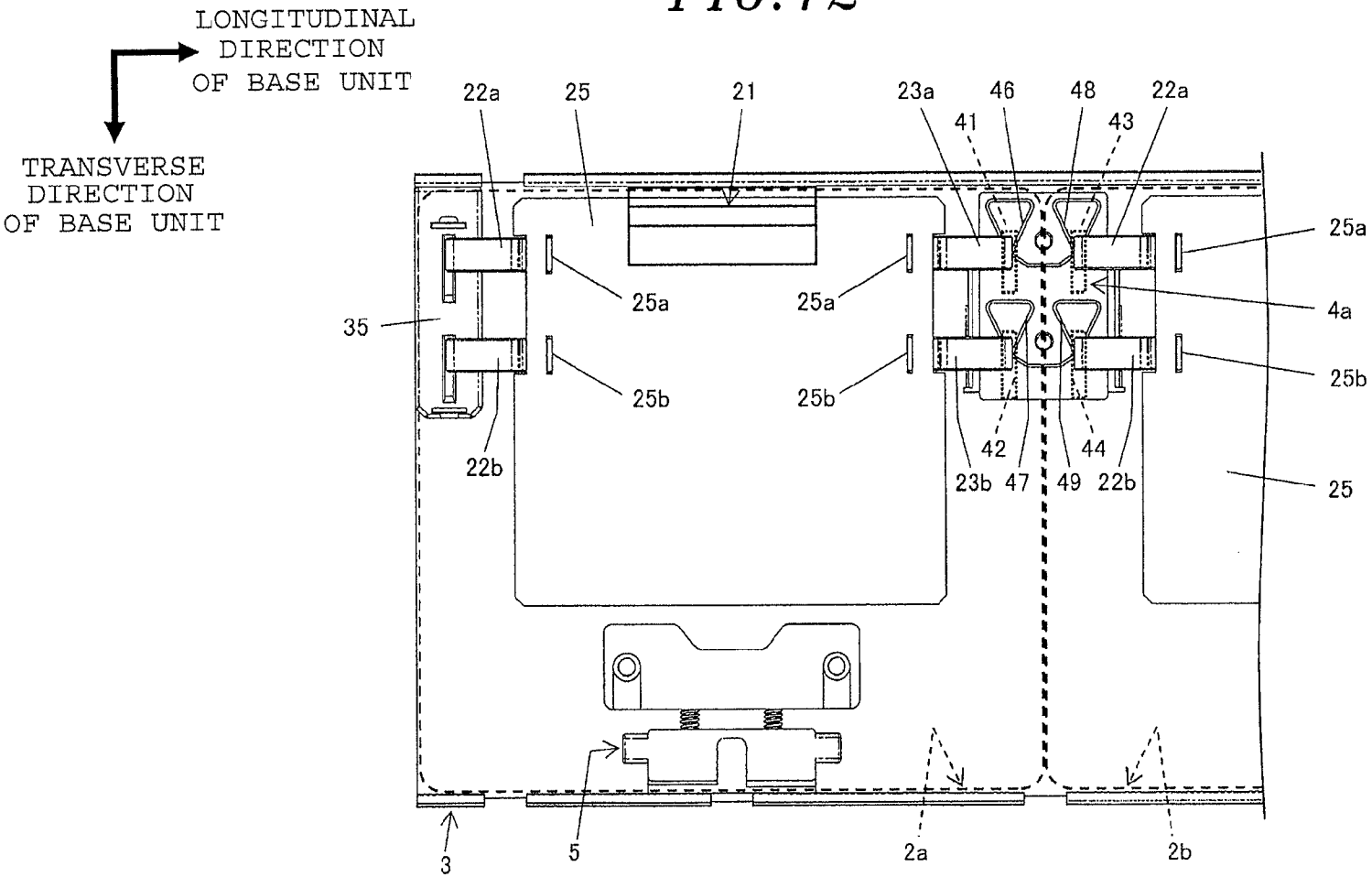
FIG. 12 is a plan view showing how to connect the connector to a current supplying terminal provided in the light source unit.
Figure 13:
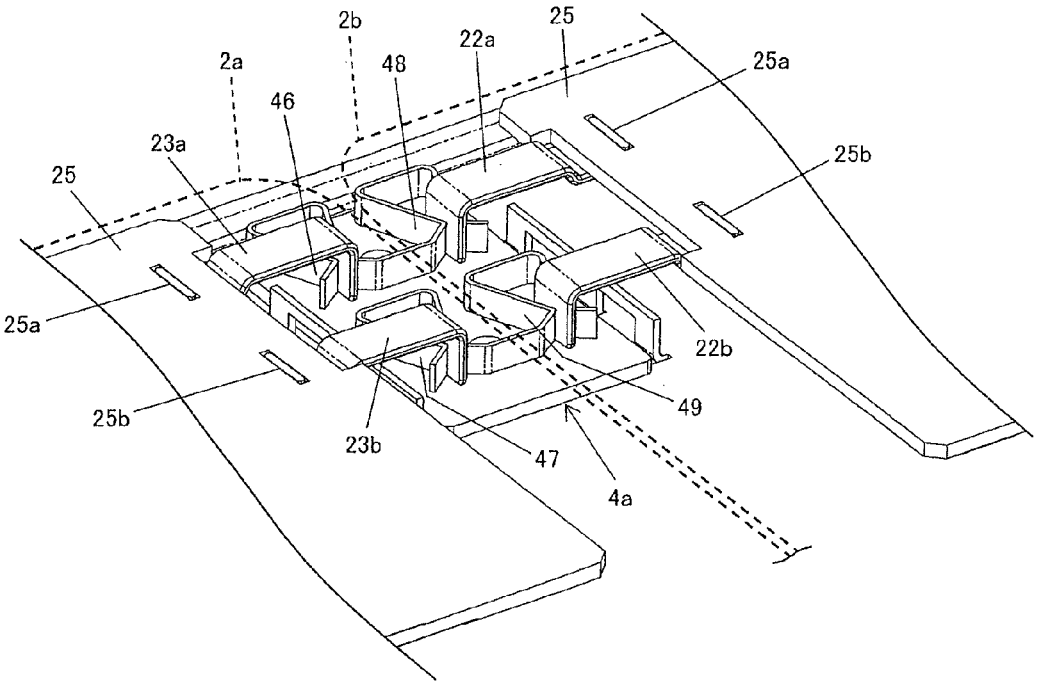
FIG. 13 is a perspective view showing how to connect the connector to the current supplying terminal.

As shown in FIGS. 12 and 13, the connector 4*a* includes a terminal receiver 46 for gripping the positive terminal 23*a* of the light source unit 2*a* inserted into the positive terminal insertion hole 41 and a terminal receiver 47 for gripping the negative terminal 23*b* of the light source unit 2*a* inserted into the negative terminal insertion hole 42. The connector 4*a* further includes a terminal receiver 48 for gripping the positive terminal 22*a* of the light source unit 2*b* inserted into the positive terminal insertion hole 43 and a terminal receiver 49 for gripping the negative terminal 22*b* of the light source unit 2*b* inserted into the negative terminal insertion hole 44. In FIGS. 12 and 13, a portion of the connector 4*a* and the case 8 are not shown.

The terminal receivers 46 to 49 are configured just like the terminal receivers 63 and 64 of the aforementioned input connector 6. Each of the terminal receivers 46 to 49 includes a pair of extension portions extending along the substantially transverse direction of the base unit 3. The corresponding current supplying terminal is resiliently gripped by the extension portions. Each of the terminal receivers 46 and 48 and each of the terminal receivers 47 and 49 are one-piece formed by bending a single leaf spring. Thus, the positive terminal 23*a* of the light source unit 2*a* and the positive terminal 22*a* of the light source unit 2*b* are electrically connected to each other through the terminal receivers 46 and 48. The negative terminal 23*b* of the light source unit 2*a* and the negative terminal 22*b* of the light source unit 2*b* are electrically connected to each other through the terminal receivers 47 and 49.

The connector 4*b* has the same structure as the aforementioned connector 4*a*. The connector 4*b* electrically interconnects the positive terminal 23*a* of the light source unit 2*b* and the positive terminal 22*a* of the light source unit 2*c* and also electrically interconnects the negative terminal 23*b* of the light source unit 2*b* and the negative terminal 22*b* of the light source unit 2*c*.

The outer surfaces of the connectors 4*a* and 4*b*, the input connector 6 and the end cap 35 are formed of an insulating material. Accordingly, it is possible to prevent a user from undergoing electric shock when mounting the light source units 2 to the base unit 3 or when replacing the light source units 2. It is also possible to prevent occurrence of tracking.

Figure 14:
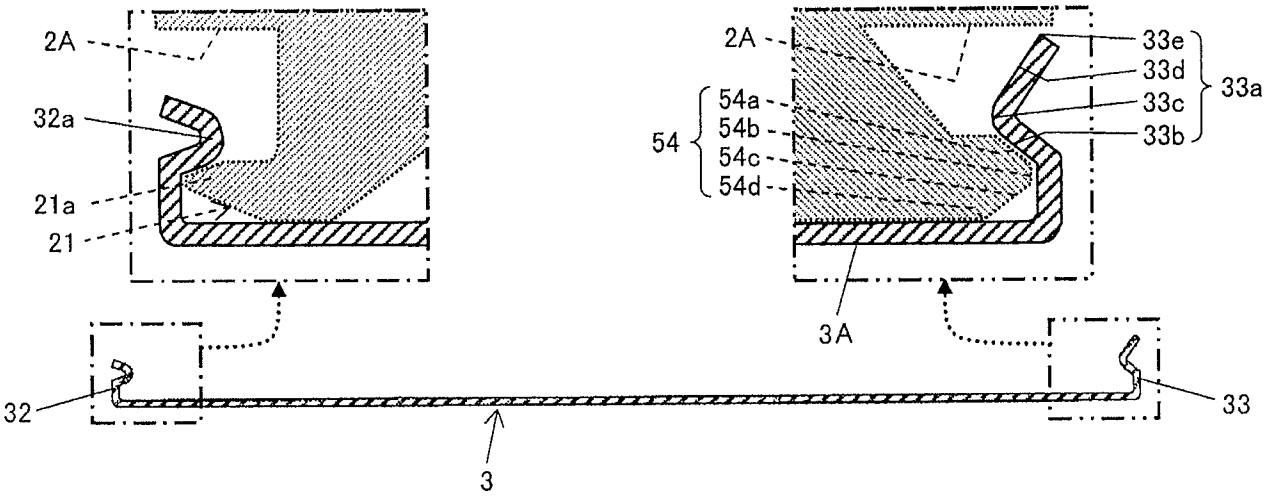
FIG. 14 is a horizontal section view of the base unit with certain portions thereof illustrated on an enlarged scale.

As shown in FIG. 14, the engaged portion 32 of the base unit 3 includes a claw 32*a* extending toward the held portion 33 so as to engage with the claw 21*a* of the engaging portion 21 (see the left enlarged view). In the meantime, the held portion 33 of the base unit 3 includes a claw 33*a* extending toward the engaged portion 32 so as to engage with the claw 54 of the holding portion 5 (see the right enlarged view). The engaged portion 32 and the held portion 33 differ in shape from each other. The engaged portion 32 engages with only the engaging portion 21. The held portion 33 engages with only the holding portion 5 (the claw 54).

The claw 33*a* of the held portion 33 includes an engaging surface 33*b* making contact with the claw 54 when the claw 33*a* of the held portion 33 engages with the claw 54 of the holding portion 5, an apex portion 33*c* and a non-engaging surface 33*d* existing at the opposite side of the apex portion 33*c* from the engaging surface 33*b*. The claw 33*a* is formed such that the apex portion 33*c* thereof is positioned nearer to the attachment surface 3A of the base unit 3 than the base end 33*e* of the non-engaging surface 33*d*.

The claw 54 of the holding portion 5 includes an engaging surface 54*a* making contact with the claw 33*a* when the claw 54 of the holding portion 5 engages with the claw 33*a* of the held portion 33, an apex portion 54*b*, and a non-engaging surface 54*c* existing at the opposite side of the apex portion 54*b* from the engaging surface 54*a*. The claw 54 is formed such that the apex portion 54*b* thereof is positioned nearer to the mounting surface 2A of each of the light source units 2 than the base end 54*d* of the non-engaging surface 54*c*.

Figure 15A:
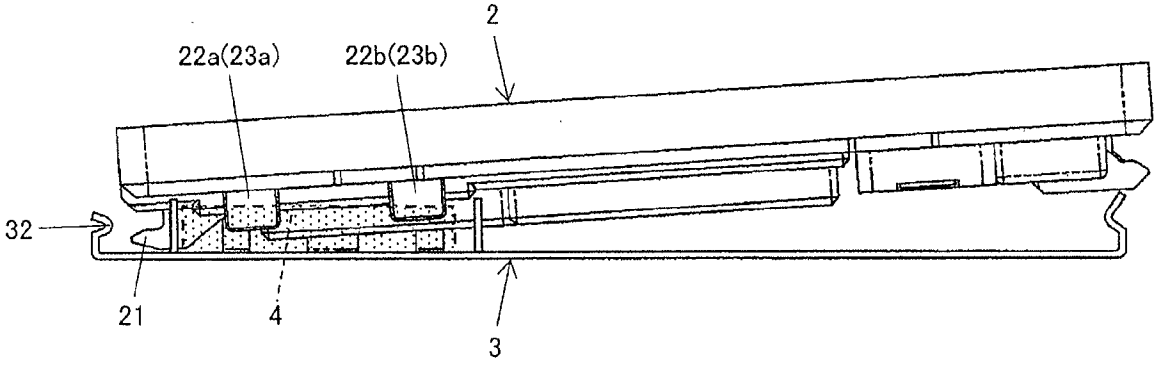
FIGS. 15A through 15C are views illustrating operations which are performed to mount the light source unit to the base unit.
Figure 15B:
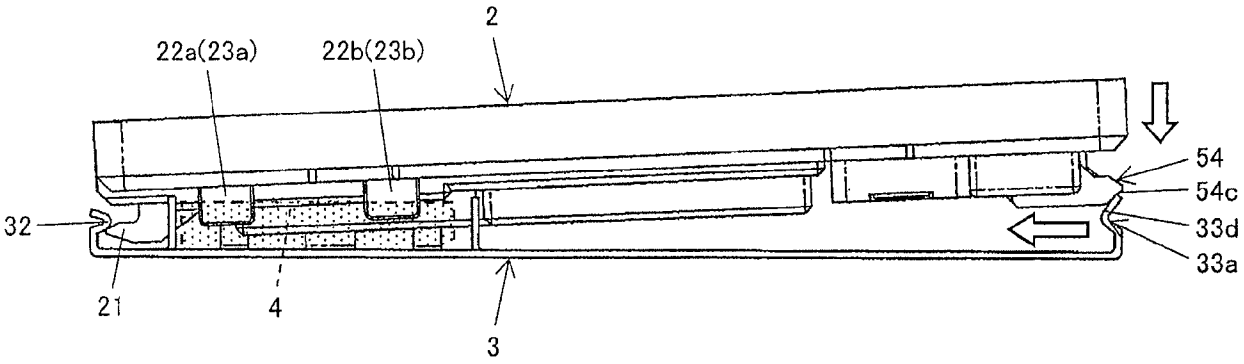
Figure 15C:
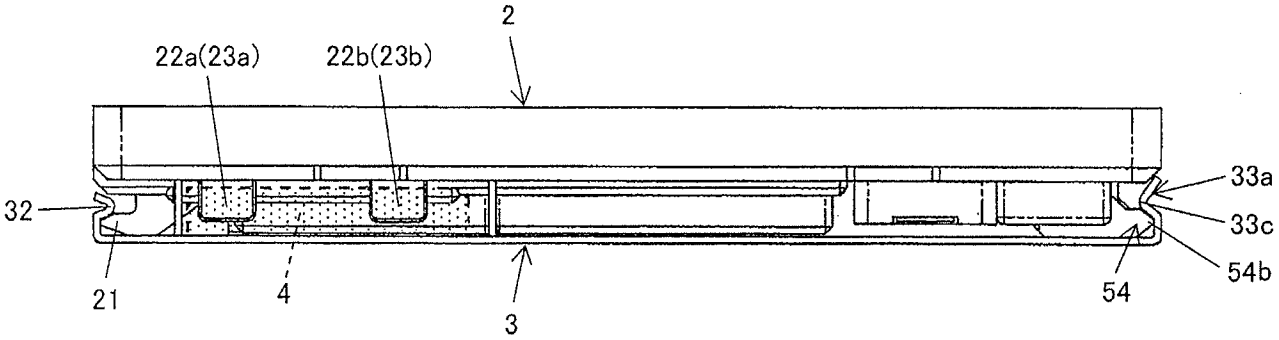

Next, the operation for mounting the light source unit 2 to the base unit 3 will be described with reference to FIGS. 15A through 15C. Initially, as shown in FIG. 15A, the light source unit 2 is obliquely put into the base unit 3 so that the engaged portion 32 of the base unit 3 and the engaging portion 21 of the light source unit 2 can come close to each other. Then, as shown in FIG. 15B, the light source unit 2 is swung toward the base unit 3 in a state that the engaged portion 32 and the engaging portion 21 are kept in engagement with each other. Thus, the claw 54 (the holding portion 5) of the light source unit 2 and the claw 33*a* (the held portion 33) of the base unit 3 are brought into contact with each other through the non-engaging surfaces 54*c* and 33*d* thereof.

In this regard, the non-engaging surface 54*c* of the claw 54 is slidable on the non-engaging surface 33*d* of the claw 33*a*. Therefore, the claw 54 slides on the non-engaging surface 33*d*. As a result, there is generated a force by which the claw 54 is caused to slide toward the engaging portion 21. Consequently, as shown in FIG. 15C, the apex portion 54*b* of the claw 54 goes over the apex portion 33*c* of the claw 33*a*, whereby the claw 54 (the holding portion 5) and the claw 33*a* (the held portion 33) come into engagement with each other. In this manner, using the slope of the non-engaging surfaces 54*c* and 33*d* of the claws 54 and 33*a*, the force generated by the swing operation is converted to a force by which the holding portion 5 is slid toward the engaging portion 21. This makes it possible to easily mount the light source unit 2 to the base unit 3.

Figure 16:
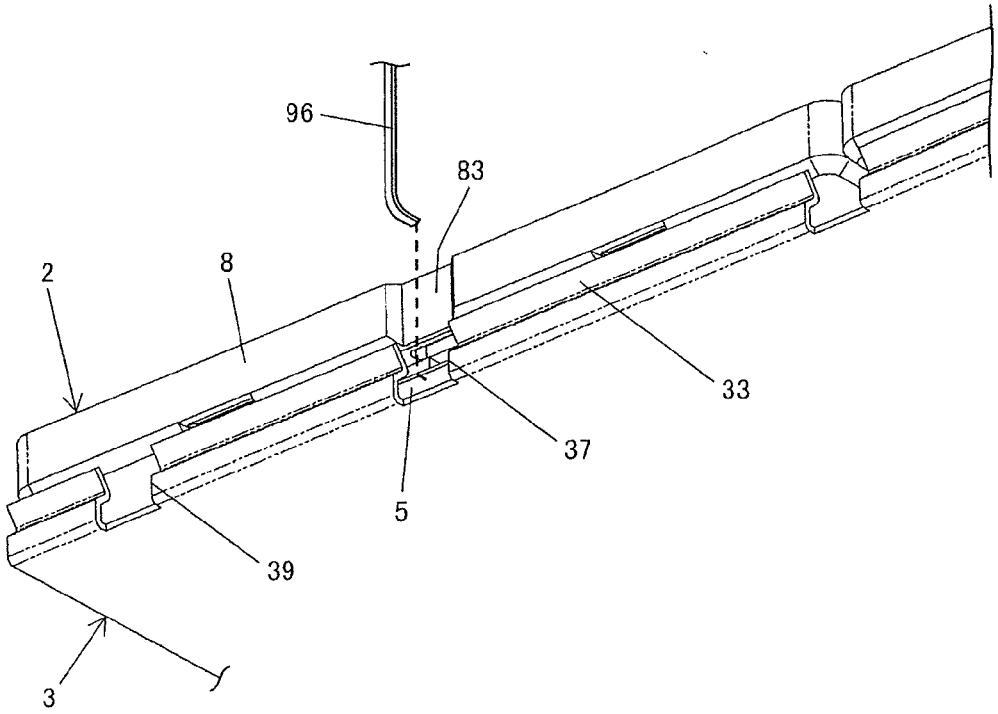
FIG. 16 is a view showing an operation which is performed to remove the light source unit from the base unit.

Next, the operation for removing the light source unit 2 from the base unit 3 will be described with reference to FIG. 16. Since the held portion 33 of the base unit 3 is provided with the cutout 37, the holding portion 5 of the light source unit 2 can be pushed from the outside of the illumination device 1. When removing the light source unit 2 from the base unit 3, the holding portion 5 is pushed with a finger, thereby sliding the holding portion 5 inwardly of the light source unit 2 and releasing the engagement of the holding portion 5 and the held portion 33. Thereafter, the operation for mounting the light source unit 2 to the base unit 3 is performed in the reverse order.

If a plurality of illumination devices 1 is arranged in a mutually-adjoining relationship through the respective held portions 33 (see, e.g., FIG. 19) or if an obstacle exists at one side of the illumination device 1, there may be a case when it is impossible to insert a finger even though a user wishes to push the holding portion 5. In this case, an elongated jig 96 with a curved tip end is inserted through the groove 83 of the case 8. The holding portion 5 is pushed by the tip end of the jig 96, thereby releasing the engagement of the holding portion 5 and the held portion 33. Alternatively, the engagement of the holding portion 5 and the held portion 33 may be released by hooking the light source unit 2 with the tip end of the jig 96 and pulling the jig 96 so that the light source unit 2 can be spaced apart from the base unit 3.

Figure 17A:
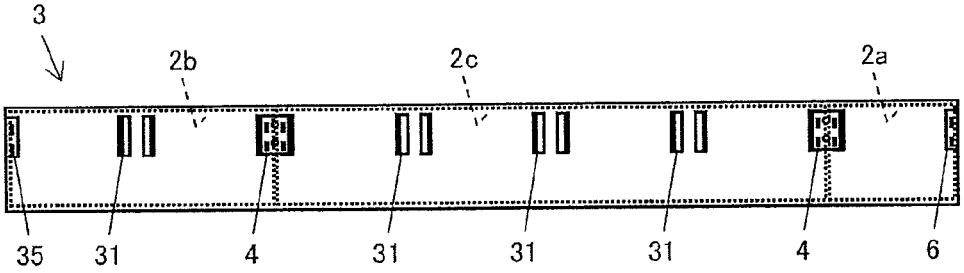
FIGS. 17A through 17C are views showing arrangement patterns of the light source units with respect to the base unit.
Figure 17B:
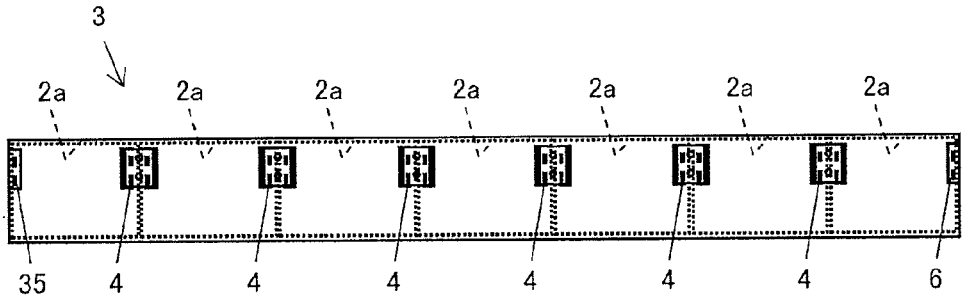
Figure 17C:
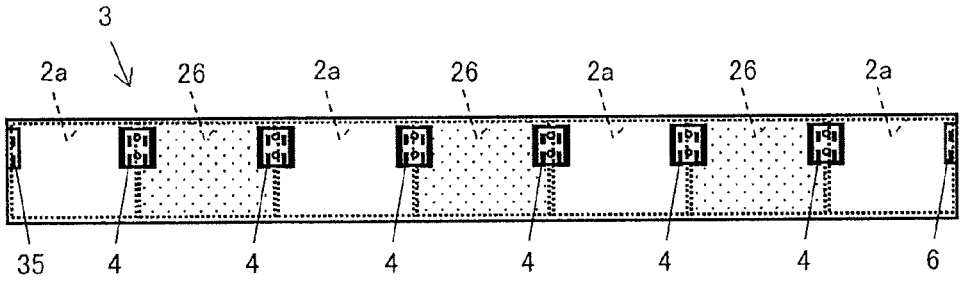

With the illumination device 1 of the present embodiment described above, the connectors 4 can be removably attached to any of the connector attachment portions 31. Therefore, the degree of freedom in arranging the light source units 2 can be increased by changing the arrangement of the connectors 4 as shown in FIGS. 17A through 17C.

The arrangement of the light source units 2*a*, 2*b*, and 2*c* is not limited to the order of 2*a*, 2*b*, and 2*c*. For example, as shown in FIG. 17A, the light source units 2*a*, 2*b*, and 2*c* may be arranged in the order of 2*b*, 2*c*, and 2*a* by changing the positions of the connectors 4. As shown in FIG. 17B, the light source units 2 may be composed of a single kind of light source unit. For example, the connectors 4 may be attached to all the connector attachment portions 31. Seven light source units 2*a* may be arranged in a mutually-adjoining relationship. The light source units 2 need not be necessarily arranged in a mutually-adjoining relationship. For example, as shown in FIG. 17C, the light source units 2*a* and dummy panels 26 (indicated by dots in FIG. 7C) as light source units having no light emitting panel may be alternately arranged in a mutually-adjoining relationship.

Since the length of the longitudinal side of each of the light source units 2*a* is equal to an integral multiple of the distance between the connector attachment portions 31, the connector attachment portions 31 are always arranged in positions corresponding to the ends of the light source units 2. The light source units 2 adjoining each other are electrically connected by the connectors 4. Each of the light source units 2 is configured to supply an electric current to the adjoining light source unit 2 through the inside thereof. For this reason, the illumination device 1 has a simple structure with no exposed lead wires. This enables a general user to easily perform the task of replacing or rearranging the light source units 2.

The longitudinal sides of the base unit 3 are parallel to each other. The transverse length of the base unit 3 is equal to the length of the side of each of the light source units 2*a*, 2*b*, and 2*c* extending in the transverse direction of the base unit 3. For this reason, each of the light source units 2*a*, 2*b*, and 2*c* can be arranged in an arbitrary region along the longitudinal direction of the base unit 3.

Since the holding portion 5 of the light source unit 2 is slidable, it becomes easy to perform the operation for attaching the light source unit 2 to the base unit 3 and the operation for removing the light source unit 2 from the base unit 3. Thus, the light source unit 2 can be replaced with ease. By making the holding portion 5 slidable, it becomes possible to attach and remove the light source unit 2 in such a manner that the light source unit 2 does not protrude beyond the base unit 3. This makes it possible to arrange the light source units 2*a*, 2*b*, and 2*c* in a close proximity with one another and to reduce the gaps between the light source units 2*a*, 2*b*, and 2*c*. As a consequence, when energizing all the light source units 2*a*, 2*b*, and 2*c*, it is possible to obtain a natural light emitting surface 2B while keeping the borders between the light source units 2*a*, 2*b*, and 2*c* invisible.

The engaged portion 32 of the base unit 3 engages with only the engaging portion 21 of the light source unit 2. The held portion 33 of the base unit 3 engages with only the holding portion 5 of the light source unit 2. Thus, the light source unit 2 is prevented from being attached to the base unit 3 in a wrong direction.

The current supplying terminals 22 and 23 of the light source unit 2 are provided nearer to the engaging portion 21 on the mounting surface 2A than to the holding portion 5. The connectors 4 (the connector attachment portions 31) are provided near the engaged portion 32 of the base unit 3. For this reason, if the engaging portion 21 of the light source unit 2 and the engaged portion 32 of the base unit 3 are caused to come close to each other when mounting the light source unit 2 to the base unit 3, the current supplying terminals 22 and 23 are partially inserted into the insertion holes 41 to 44 of the connectors 4 (indicated by dots in FIG. 15A). If the light source unit 2 is swung toward the base unit 3 in this state, the engaging portion 21 and the engaged portion 32 come into engagement with each other. At the same time, the current supplying terminals 22 and 23 are completely inserted into the insertion holes 41 to 44 of the connectors 4. In this manner, the engagement of the engaging portion 21 and the engaged portion 32 and the insertion of the current supplying terminals 22 and 23 into the connectors 4 can be simultaneously performed by the swing operation. This helps enhance the operability.

Since the current supplying terminals 22 and 23 are partially inserted into the insertion holes 41 to 44 of the connectors 4 prior to the swing operation, it is possible to make sure that the light source unit 2 is attached to the base unit 3 in a right position. Inasmuch as the current supplying terminals 22 and 23 are inserted into the insertion holes 41 to 44 of the connectors 4 by the swing operation, it is possible to prevent the light source unit 2 from getting out of alignment with respect to the base unit 3 during the swing operation.

The extension portions of the terminal receivers 46 to 49 of the connectors 4 and the extension portions of the terminal receivers 63 and 64 of the input connector 6 extend along the substantially transverse direction of the base unit 3 (see FIG. 12). For that reason, when the light source unit 2 is swung with respect to the base unit 3, the terminal receivers 46 to 49 do not impede the swing operations of the current supplying terminals 22 and 23. It is therefore possible to smoothly perform the swing operation. Since the current supplying terminals 22 and 23 are arranged in the end portions of the light source unit 2, a space for accommodating other members can be provided in the central region of the light source unit 2. This makes it possible to reduce the thickness of the light source unit 2.

Figure 18A:
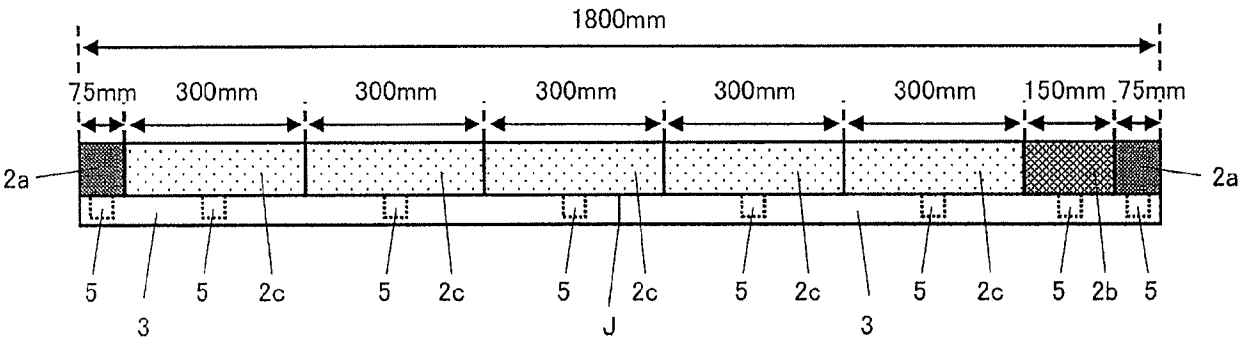
FIGS. 18A and 18B are side views of an illumination device according to a first modified example of the foregoing embodiment.
Figure 18B:
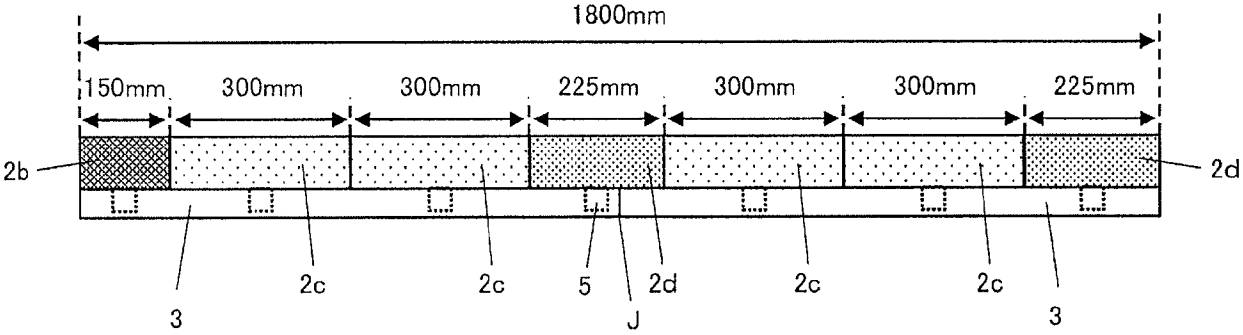

Next, an illumination device according to a first modified example of the present embodiment will be described with reference to FIGS. 18A and 18B. In the illumination device 11 of the first modified example, two base units 3 are connected to each other at a joint portion J. One of the light source units 2 is arranged to extend over the joint portion J. In the illustrated example, two base units 3 each having a longitudinal dimension of 900 mm are connected to each other, thereby forming an illumination device 11 having a total length of 1800 mm. The arrangement in which one of the light source units 2 extends over the joint portion J can be realized in case of using the light source units 2*b* or the light source unit 2*c* having a length more than twice as large as the distance between the connector attachment portions 31 (75 mm). In case of using the light source unit 2*b*, however, the holding portion 5 thereof is positioned in the joint portion J. Therefore, the engagement of the light source unit 2*b* and the base unit 3 becomes unstable. Accordingly, as shown in FIG. 18A, it is desirable to arrange the light source unit 2*c* in such a way that the holding portion 5 thereof is not positioned in the joint portion J.

In a case where the light source units 2 are composed of three kinds of light source units 2*a*, 2*b* and 2*c* as set forth above, only the light source unit 2*c* can be appropriately used as the light source unit 2 extending over the joint portion J. This limits the arrangement patterns of the light source units 2. In light of this, as shown in FIG. 18B, there may be further provided a light source unit 2*d* whose side extending along the longitudinal direction of the base unit 3 has a length of 225 mm. The light source unit 2*d* can extend over the joint portion J without the holding portion 5 thereof being positioned in the joint portion J. If the light source unit 2*d* as well as the light source unit 2*c* is used as the light source unit 2 extending over the joint portion J, the degree of freedom in arranging the light source units 2 becomes higher than when only the light source unit 2*c* is used as the light source unit 2 extending over the joint portion J.

With the illumination device 11 of the first modified example, it is possible to interconnect two base units 3. The number of the base units 3 connected to one another is not limited to two but may be three or more.

Figure 19:
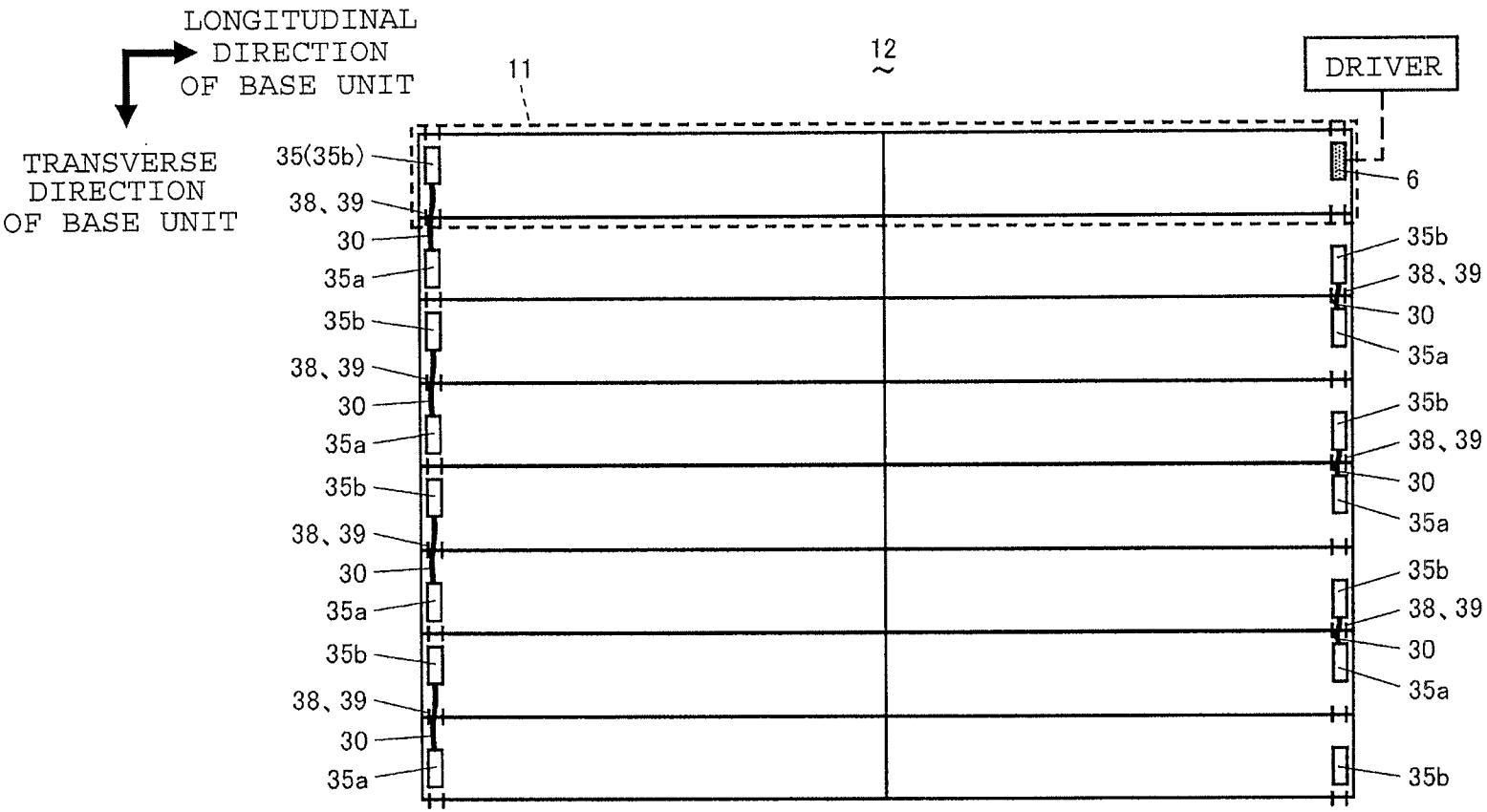
FIG. 19 is a plan view of an illumination device according to a second modified example of the foregoing embodiment.

Next, an illumination device according to a second modified example of the present embodiment will be described with reference to FIG. 19. In the illumination device 12 of the second modified example, eight illumination devices 11 described above are arranged along the transverse direction of the base unit 3 in a mutually-adjoining relationship. In FIG. 19, the light source units 2, the connectors 4 and the connector attachment portions 31 are not shown.

In the illumination device 12, the illumination device 11 arranged at one end (the upper end in the illustrated example) of the illumination device 12 includes an input connector 6 arranged in one longitudinal end portion thereof and an end cap 35 arranged in the other longitudinal end portion thereof. The input connector 6 is connected to the driver set forth above. In the meantime, each of the remaining illumination devices 11 includes end caps 35 arranged in the longitudinal opposite end portions thereof. In order to distinguish the two end caps 35 of each of the remaining illumination devices 11 from each other, the end cap 35 positioned at the upstream side of an electric circuit will be referred to as "upstream end cap 35*a*" and the end cap 35 positioned at the downstream side of the electric circuit will be referred to as "downstream end cap 35*b*".

The current supplying terminals (not shown) inserted into the downstream end cap 35*b* of each of the illumination devices 11 are electrically connected via conductors 30 such as lead wires to the current supplying terminals arranged outside the base unit 3. In the illustrated example, the current supplying terminals inserted into the downstream end cap 35*b* are electrically connected via the conductors 30 to current supplying terminals (not shown) inserted into the upstream end cap 35*a* of the adjoining illumination device 11 existing at the downstream side in the electric circuit. Thus, the respective illumination devices 11 are electrically serially connected to one another. The conductors 30 are arranged to extend through conductor extraction portions 38 and 39.

The light emitting layer of the organic EL element is formed by, e.g., applying a light-emitting organic material injected from a slit nozzle. In this case, the width of the light emitting layer cannot be set larger than the width of the slit nozzle. This makes it difficult to obtain an illumination device having a large light-emitting surface. With the illumination device 12, a plurality of illumination devices 11 can be electrically connected to one another in a mutually-adjoining state. It is therefore possible to obtain an illumination device having a large light-emitting surface as a whole. The conductors 30 are arranged to extend through the conductor extraction portions 38 and 39 and, therefore, are not exposed to the outside of the illumination device 12. As a consequence, it is possible to improve the external appearance of the illumination device 12.

Figure 20:
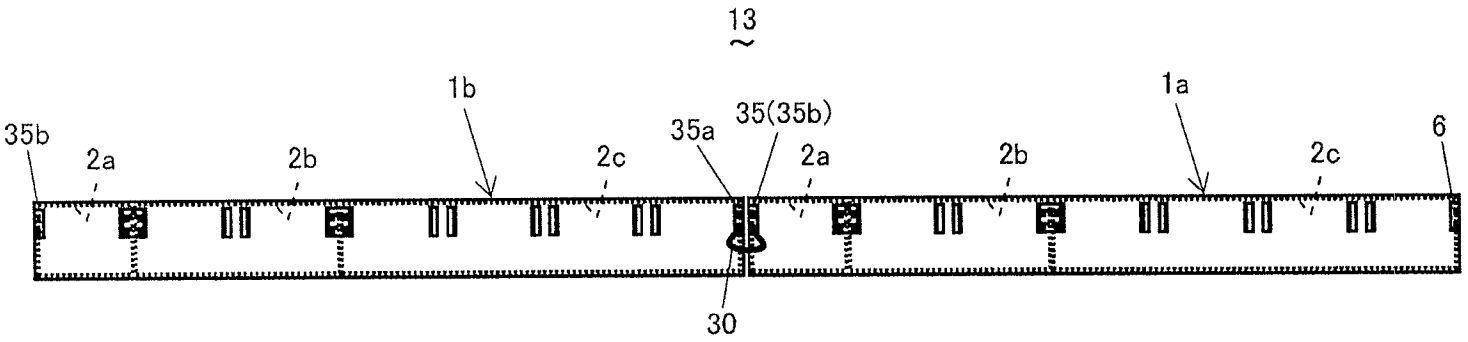
FIG. 20 is a plan view of an illumination device according to a third modified example of the foregoing embodiment.

Next, an illumination device according to a third modified example of the present embodiment will be described with reference to FIG. 20. In the illumination device 13 of the third modified example, two illumination devices 1 described above are serially connected to each other by conductors 30 such as lead wires. One illumination device 1*a* includes an input connector 6 arranged in one longitudinal end portion thereof and an end cap 35 (a downstream end cap 35*b*) arranged in the other longitudinal end portion thereof. The other illumination device 1*b* includes an upstream end cap 35*a* arranged in one longitudinal end portion thereof and a downstream end cap 35*b* arranged in the other longitudinal end portion thereof. The conductors 30 electrically interconnect the current supplying terminals (not shown) inserted into the end cap 35*b* of the illumination device 1*a* and the current supplying terminals (not shown) inserted into the end cap 35*a* of the illumination device 1*b*.

With the illumination device 13, a plurality of illumination devices 1 can be electrically connected to one another in a simple configuration. The number of the illumination devices 1 connected to one another is not limited to two but may be three or more.

The illumination device according to the present invention is not limited to the aforementioned embodiment and the modified examples thereof but may be modified in many different forms. For example, the length of the side of the light source unit extending along the longitudinal direction of the base unit need not necessarily be an integral multiple of the distance between the connector attachment portions but may be an arbitrary length. A pair of longitudinal sides of the base unit need not necessarily be parallel to each other. The method of mounting the light source units to the base unit is not limited to engagement of the engaged portion and the engaging portion and engagement of the held portion and the holding portion. For example, the light source units may be screw-fixed to the base unit. The light source of each of the light source units is not limited to the organic EL element but may be, e.g., an LED or a fluorescent lamp.

While the invention has been shown and described with respect to the embodiments, it will be understood by those skilled in the art that various changes and modification may be made without departing from the scope of the invention as defined in the following claims.

What is claimed is:

1. An illumination device, comprising:

a plurality of flat light source units; and an elongated base unit to which the light source units are removably mounted, wherein the base unit includes a plurality of connectors connected to the light source units and used in supplying an electric current to the light source units and a plurality of connector attachment portions arranged at a specified interval along a longitudinal direction of the base unit, the connectors being removably attached to the connector attachment portions, and wherein each of the light source units is configured such that, when mounted to the base unit, the length of each of the light source units in the longitudinal direction of the base unit is n times of the distance between centers of two neighboring connector attachment portions, n being an integer greater than 1.

2. The device of claim 1, wherein each of the connectors is arranged in a border position between two light source units adjoining each other when the light source units are mounted to the base unit in a mutually-adjoining relationship along the longitudinal direction of the base unit, each of the connectors being configured to electrically interconnect the two light source units adjoining each other.

3. The device of claim 1, wherein the base unit includes a pair of parallel sides extending in the longitudinal direction of the base unit, a transverse length of the base unit being equal to the length of each of the light source units in a transverse direction of the base unit.

4. The device of claim 3, wherein the base unit includes an engaged portion arranged along one longitudinal side thereof and a held portion arranged along the other longitudinal side thereof, the engaged portion and the held portion being used in mounting the light source units to the base unit; and each of the light source units includes an engaging portion provided in a central region of one edge portion of a mounting surface of each of the light source units facing the base unit when the light source units are mounted to the base unit and configured to engage with the engaged portion of the base unit and a holding portion provided in a central region of the other edge portion of the mounting surface and configured to engage with the held portion of the base unit.

5. The device of claim 4, wherein the engaged portion and the held portion differ in shape from each other, the engaged portion engaging with only the engaging portion, the held portion engaging with only the holding portion.

6. The device of claim 4, wherein each of the light source units is configured to be able to swing toward the base unit in a state that the engaging portion is brought into engagement with the engaged portion of the base unit, the holding unit resiliently biased away from the engaging portion.

7. The device of claim 6, wherein the held portion includes a claw extending toward the engaged portion;

the holding portion includes a claw engageable with the claw of the held portion;

the claws of the held portion and the holding portion are configured to, when each of the light source units is swung toward the base unit with the engaging portion brought into engagement with the engaged portion of the base unit, make contact with each other and generate a force by which the holding portion is slid toward the engaging portion.

8. The device of claim 6, wherein each of the light source units includes current supplying terminals upstanding from the mounting surface, a part of the current supplying terminals of the light source units are inserted into each of the connectors.

9. The device of claim 8, wherein the current supplying terminals are provided nearer to the engaging portion than the holding portion, the connector attachment portions provided nearer to the engaged portion than the held portion.

10. The device of claim 8, wherein each of the connectors includes terminal receivers extending along the transverse direction of the base unit when the connectors are attached to the connector attachment portions, the terminal receivers of the connectors configured to grip the part of the current supplying terminals.

11. The device of claim 8, wherein the current supplying terminals of each of the light source units are provided in the opposite end portions of the mounting surface along a direction orthogonal to a direction interconnecting the engaging portion and the holding portion, the current supplying terminals of each of the light source units being electrically connected to each other.

12. The device of claim 11, wherein each of the current supplying terminals of the light source units includes a positive terminal and a negative terminal arranged side by side along a direction parallel to the direction interconnecting the engaging portion and the holding portion.

13. The device of claim 11, wherein the base unit includes an end cap arranged in one longitudinal end portion of the illumination device and one light source unit among the plurality of light source units, arranged in the one longitudinal end portion of the illumination device includes a current supplying terminal positioned in one longitudinal end portion of said one light source unit, the current supplying terminal being inserted into the end cap, and the end cap having a surface made of an insulating material.

14. The device of claim 13, wherein the base unit includes an input connector arranged in the other longitudinal end portion of the illumination device, another light source unit among the plurality of light source units, arranged in the other longitudinal end portion of the illumination device includes a current supplying terminal positioned in one longitudinal end portion of said another light source unit, the current supplying terminal being inserted into the input connector, the input connector configured to electrically connect the current supplying terminals of the light source units to a commercial power source, a driver or another illumination device.

15. The device of claim 13, wherein the current supplying terminal inserted into the end cap is electrically connected via conductors to current supplying terminals provided outside the base unit.

16. The device of claim 15, wherein the conductors are extracted outward through a conductor extraction portion provided in the engaged portion or the held portion.

17. The device of claim 16, wherein the held portion includes cutouts arranged in positions corresponding to the holding portions of the light source units mounted to the base unit.

18. The device of claim 1, wherein each of the light source units has a mounting surface facing the base unit when the light source units are mounted to the base unit and current supplying terminals upstanding from the mounting surface.

* * * * *